US007096565B2

(12) United States Patent
Haapalahti et al.

(10) Patent No.: US 7,096,565 B2
(45) Date of Patent: Aug. 29, 2006

(54) FLANGED INNER CONDUCTOR COAXIAL RESONATORS

(75) Inventors: Teuvo Haapalahti, Oulunsalo (FI); Pekka Jokilehto, Toppila (FI); Tapio Suvanto, Liminika (FI); Pentti Mehtätalo, Haukipudas (FI)

(73) Assignee: Powerwave Technologies, Inc., Santa Ana, CA (US)

( * ) Notice: Subject to any disclaimer, the term of this patent is extended or adjusted under 35 U.S.C. 154(b) by 355 days.

(21) Appl. No.: 10/600,151

(22) Filed: Jun. 19, 2003

(65) Prior Publication Data

US 2004/0257177 A1 Dec. 23, 2004

(51) Int. Cl.
*H04R 31/00* (2006.01)

(52) U.S. Cl. ..... 29/594; 29/443; 29/731; 29/753; 29/754; 29/761; 72/370.11; 333/203; 333/206; 333/222

(58) Field of Classification Search ..... 29/594, 29/731, 753, 754, 761, 443; 72/370.11; 333/203, 333/206, 222
See application file for complete search history.

(56) References Cited

U.S. PATENT DOCUMENTS

| | | | | |
|---|---|---|---|---|
| 4,287,494 A | | 9/1981 | Hashimoto et al. | 333/202 |
| 4,538,338 A | * | 9/1985 | Hoeffken et al. | 29/509 |
| 5,622,071 A | | 4/1997 | Van Riper et al. | 72/117 |
| 6,114,928 A | | 9/2000 | Smith | 333/202 |
| 6,198,363 B1 | | 3/2001 | Vuoppola et al. | 333/202 |
| 6,427,517 B1 | * | 8/2002 | McMillan | 73/1.19 |
| 6,501,349 B1 | * | 12/2002 | Jokilehto et al. | 333/222 |

FOREIGN PATENT DOCUMENTS

| | | | |
|---|---|---|---|
| DE | 3107059 A1 | * | 9/1982 |
| EP | 0 533 394 A2 | | 9/1992 |
| EP | 1 111 709 A1 | | 11/2000 |
| WO | WO 00/38270 A1 | | 6/2000 |

OTHER PUBLICATIONS

"A modified open-ended coaxial probe for concave surface coating materials testing"; Hassan, A.-K.A.; Deming Xu; Lin Zhang; Maode Niu; YuJian Zhang; Microwave Symposium Digest., vol. 3, Jun. 11-16, 2000, pp. 1867-1870.*

King Forge & Machine: A division of SSP Fittings Corp., product brochure for "VERSAtool™: Tube Prep Center", Twinsburg, Ohio 44087 (2002).

* cited by examiner

*Primary Examiner*—Paul D. Kim
(74) *Attorney, Agent, or Firm*—Heller Ehrman LLP

(57) ABSTRACT

A method and apparatus for making an inner conductor from a conductive body integrally forms a flange on one end of the conductive body. The flange is formed integral to the conductive body by flaring the end of the conductive body. The size and shape of the flange is selected to achieve a desired capacitance surface area for use in a resonator. A resonator housing that has a plurality of cavities can be provided with a plurality of conductive bodies that are inserted into holes located in a bottom wall of the resonator body and that protrude into the plurality of cavities. The resonator housing and conductive bodies are placed onto a flanging fixture to produce a flange on each conductive body of a desired size and shape to achieve a desired capacitance surface area. The plurality of conductive bodies can be simultaneously flanged and fastened to the base of the resonator housing.

16 Claims, 29 Drawing Sheets

FLANGED INNER CONDUCTOR COAXIAL RESONATORS

BACKGROUND OF THE INVENTION

1. Field of the Invention

This invention relates generally to radio frequency resonators and, more particularly, to inner conductors of radio frequency coaxial resonators.

2. Description of the Related Art

Coaxial resonators are used in a wide variety of applications, including filters and oscillators used in communication systems. Coaxial resonators offer advantages over other resonator construction techniques, such as discrete components, microstrip, and transmission line filters that can suffer from high dissipation, resulting in lower Q-values. In addition, these techniques can require large physical dimensions for proper operation.

Coaxial resonators can provide improved Q-values over other resonator construction techniques. FIG. 1 is a side elevation of a typical coaxial resonator 100 of conventional construction. The FIG. 1 resonator includes an inner conductor 102 placed within a cavity 104 that is formed from an enclosure having sidewalls 106, a bottom wall 108, and a top wall 110. The interior surface 111 of the enclosure cavity 104 is conductive. The inner conductor 102 is attached to the enclosure at the bottom wall 108, thereby providing an electric short-circuit path between the cavity enclosure 104 and the inner conductor 102. The free end 112 of the inner conductor 102 is an open-circuit, providing capacitive coupling between the inner conductor and the inner surface 111 of the cavity enclosure.

Coaxial resonators constructed as illustrated in FIG. 1 can provide the benefit of relatively high Q-values. The length of the inner conductor 102 for these types of coaxial resonators is on the order of one fourth of the wavelength ($\lambda/4$) of the desired operating frequency. The length of the inner conductor that is required for such quarter-wavelength conductors can be a drawback when trying to minimize the size of the resonator.

FIG. 2 illustrates a resonator 200 that maintains the advantage of a high Q-value while decreasing the length of the inner conductor for a given operating frequency. In FIG. 1 and FIG. 2, and in all the drawings, like reference numerals refer to like structures. As illustrated in FIG. 2, a transverse disk 202 is added to the free end 112 of the inner conductor 102. The disk 202 has a larger diameter than that of the inner conductor 102. An advantage of the resonator 200 illustrated in FIG. 2 is that the surface area of the disk 202 and the distances between the disk 202 and the interior wall surfaces 106, 108, 110 of the cavity enclosure can be dimensioned to increase the capacitance between the free end of the inner conductor and the cavity 104. Increasing the capacitance between the free end of the inner conductor and the cavity allows the overall length of the inner conductor to be decreased for a given operating frequency. Thus, a resonator of more compact dimensions can be provided.

A drawback to the resonator illustrated in FIG. 2 is that additional manufacturing steps are required as compared with the FIG. 1 construction to make the disk 202 and to attach it to the free end 112 of the inner conductor 102. A technique to overcome this drawback is to machine the inner conductor 102 and disk 202 from a single piece of raw material, starting with a solid block. While this technique overcomes the problems of making a separate disk and attaching the disk to the free end of the inner conductor, the machining process is relatively expensive and time consuming.

Another technique to overcome the additional manufacturing steps required to make the disk and attach it to the free end of the inner conductor is to manufacture the inner conductor using a deep-drawing method. In a deep-drawing method, a piece of raw material, typically a sheet of material, is held around its edges and is struck repeatedly in its center by a tip of an impact tool. As the tool strikes the material, the material is drawn in the direction of the impact, thereby forming a projection that extends from the raw material in the direction of impact. After the projection has reached a desired length, the projection is cut from the material. The projection can be cut from the sheet material so that a portion of the sheet material remains with the projection to form a transverse edge. In this way, an inner conductor with free-end disk can be formed. Although the projection cutting process can form the end of the projection to a desired shape, the repeated striking and the cutting processes are generally expensive and time consuming.

There is therefore a need in the art for an improved apparatus and method of making flanged conductive bodies for use as inner conductors in resonators.

SUMMARY

An inner conductor for use in a resonator includes a conductive body that is constructed with a flange on one end, the flange being formed integral to the conductive body by flaring the end of the conductive body, wherein the size and shape of the flange is selected to achieve a desired capacitance surface area for use in a resonator. The conductive body can be located within a cavity of a resonator enclosure that has side walls and a top wall and a bottom wall such that the flanged end of the conductive body faces the top cavity wall and the opposite end of the conductive body is coupled to the bottom cavity wall. The flange of the conductive body is integrally formed from the conductive body by flaring the end of the conductive body in a flanging operation. The size and shape of the flange is selected to achieve a desired capacitance between the conductor and the top wall of the cavity.

The integral flanges can be formed during construction of a resonator by assembling a resonator housing that has a plurality of cavities having side walls and a bottom wall, and attaching a plurality of hollow conductive bodies to the bottom wall of the cavities such that the conductive bodies protrude into the cavities. The resonator housing and conductive bodies can then be placed onto a flanging fixture that includes a plurality of flanging tools arranged such that one flanging tool is aligned with each of the conductive bodies, and such that an aligned flanging tool is inserted within an opening in the protruding end of the corresponding hollow conductive body. The resonator housing with the conductive bodies is moved relative to the flanging tools such that the end of each conductive body is pressed over a corresponding flanging tool, causing the protruding end of the associated conductive body to be flared, and thereby producing a flange of a desired size and shape to achieve a desired capacitance surface area. A plurality of clamping bushings can be inserted into the open ends of the conductive bodies that are in the bottom wall of the resonator cavities, and a riveting tool head pressed into each of the corresponding clamping bushings so that the plurality of clamping bushings attach the plurality of conductive bodies to the base of the resonator housing. This simultaneously affixes the now-flanged conductive bodies to the resonator housing.

Other features and advantages of the present invention should be apparent from the following description of the preferred embodiments, which illustrate, by way of example, the principles of the invention.

DETAILED DESCRIPTION

An apparatus and method for low cost fabrication of flanged conductive bodies for use as inner conductors in resonators is described. An inner conductor can be formed to a desired shape and then installed into a resonator, or the inner conductor can be simultaneously formed to a desired shape and installed into the resonator. The inner conductor can be constructed from an elongated conductive cylinder or extrusion that is shaped to have an integral flange formed on at least one end. The base cylinder or extrusion can have any suitable cross-sectional shape, for example, tubular, oval, or rectangular. The extrusion can be constructed of copper tubing in readily available sizes, such as 8 mm diameter by 1 mm wall thickness; 10 mm×1 mm; 12 mm×1 mm; and 14 mm×1 mm. Tubing with larger diameters and wall thickness can also be used, according to the operating frequencies of the resonators to be constructed. Similarly, conductive materials other than copper can be used, such as soft steel, brass, or aluminum, or other materials that can provide sufficient performance as the inner conductors of resonators for the frequencies of interest.

Figure 1:
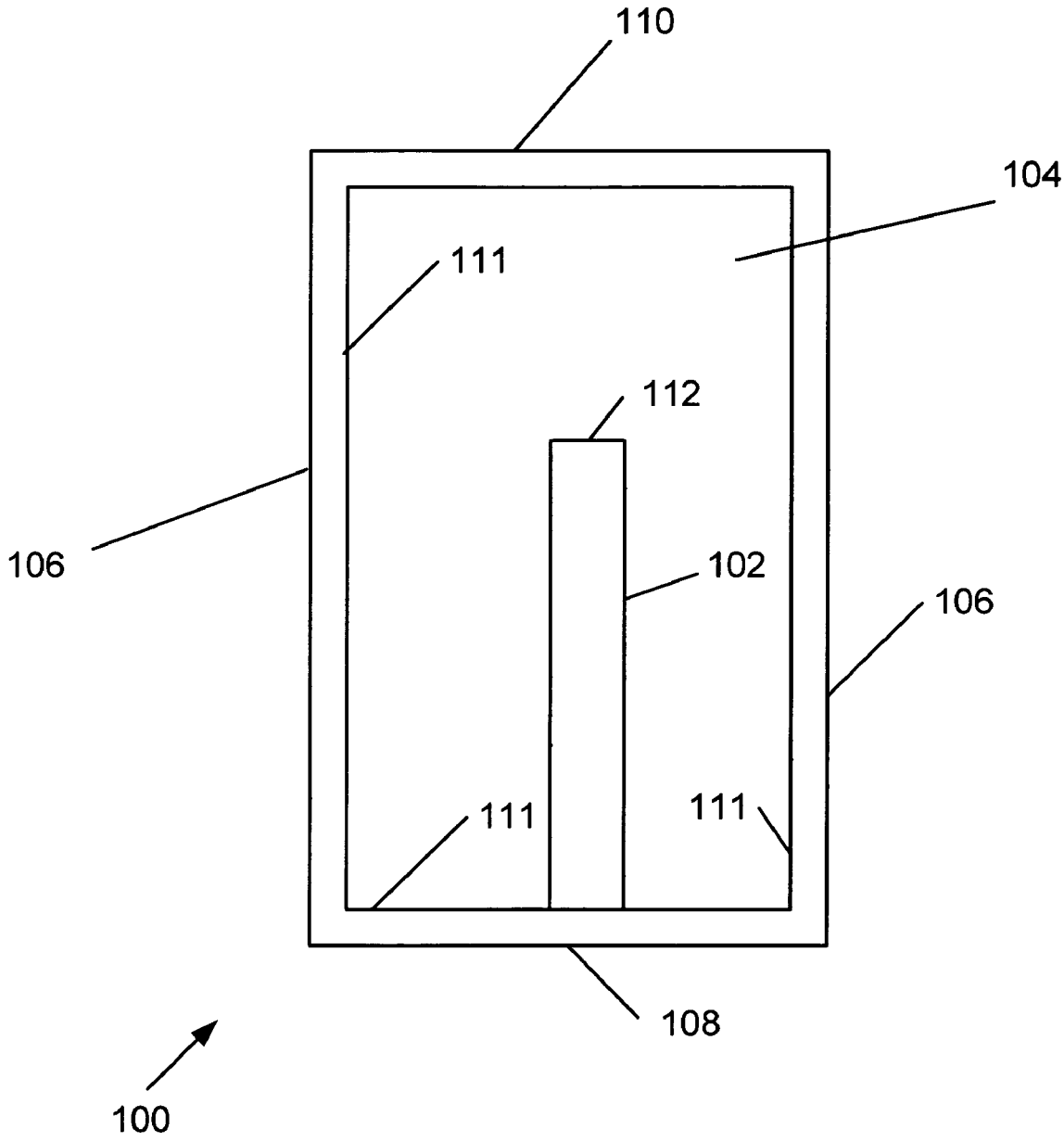
Prior Art Figure 1
FIG. 1 is a side elevation view of a typical conventional coaxial resonator.
Figure 2:
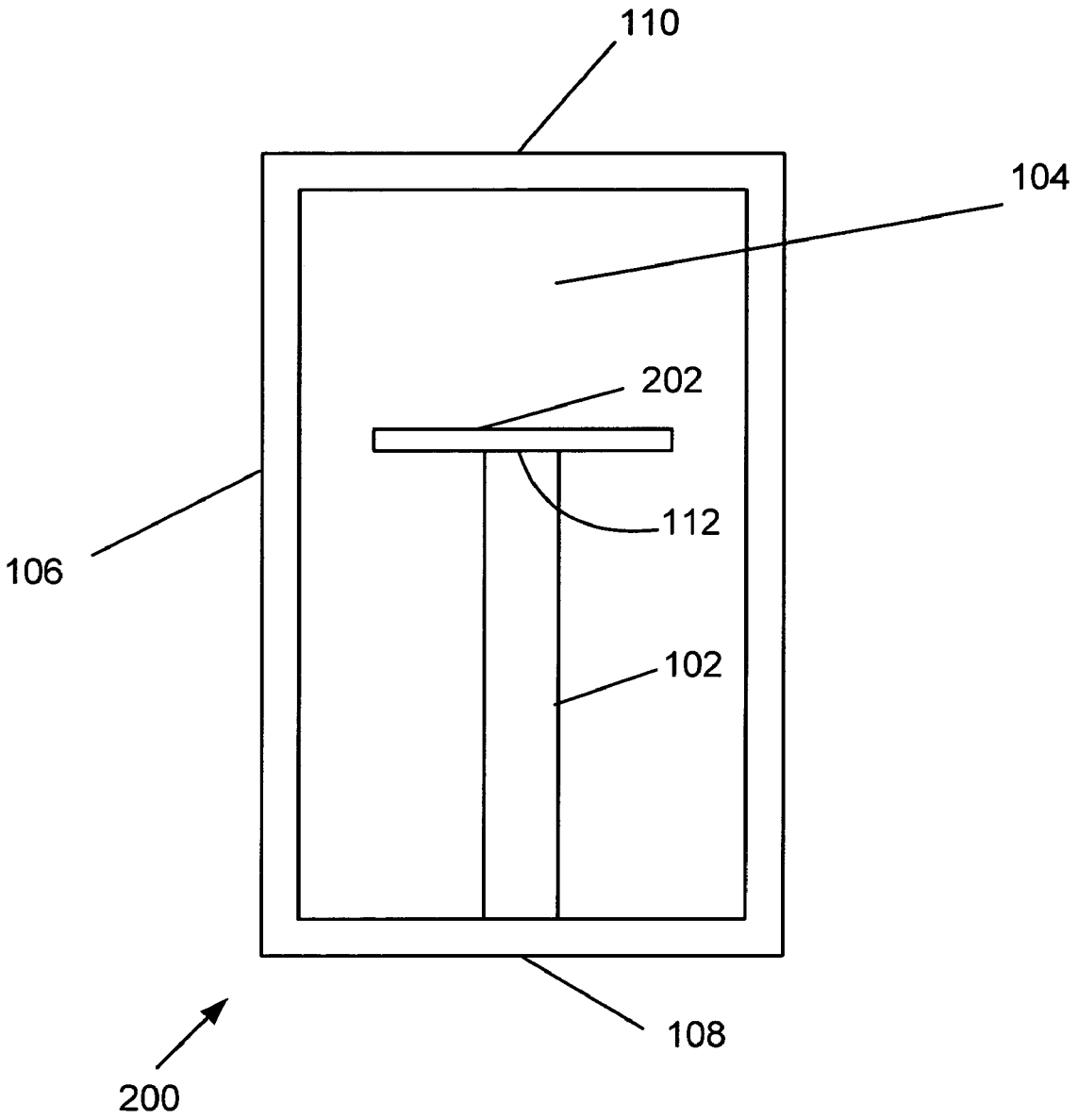
Prior Art Figure 2
FIG. 2 is a side elevation view of a second conventional coaxial resonator design, with a conductive body having a transverse disk.
Figure 3:
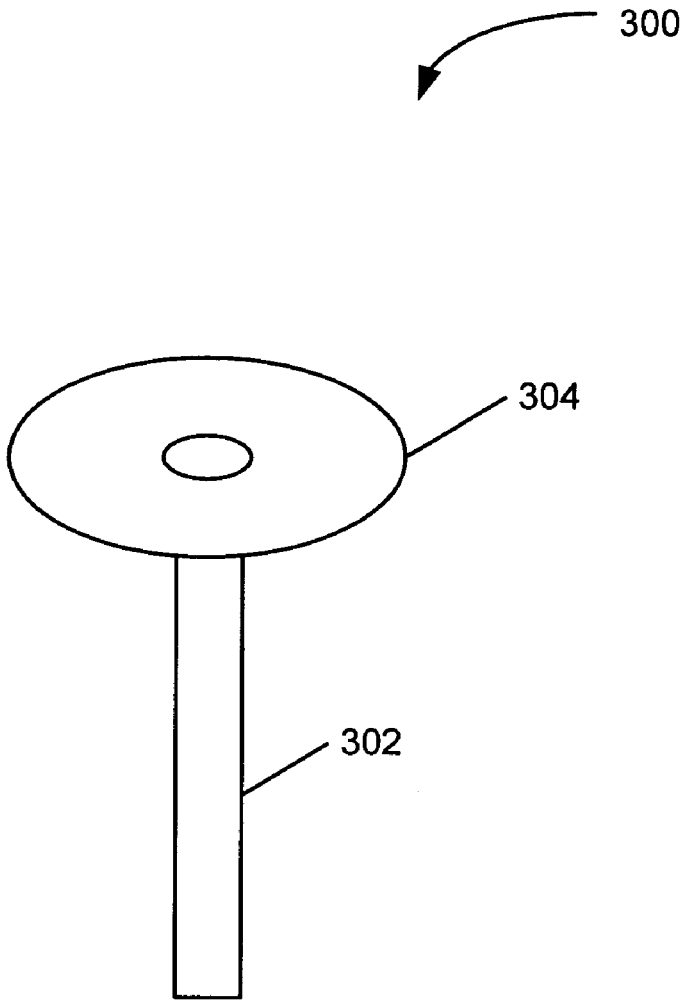
FIG. 3 is a diagram of an embodiment of an integrally flanged conductive body constructed in accordance with the invention.

FIG. 3 is a diagram of an embodiment of an integrally flanged conductive body 300 constructed in accordance with the invention. The flanged conductive body 300 shown in FIG. 3 includes a conductive body 302 with an integrally formed transverse flange 304. The size and shape of the flange are selected to achieve a desired capacitance between the flanged end of the conductive body and a surface of a conductive cavity of a resonator housing, as described below in greater detail.

Figure 4A:
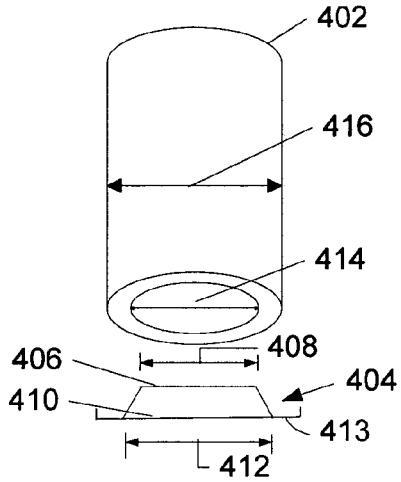
FIGS. 4A, 4B, and 4C illustrate apparatus and operations of a technique for making an integral flange on an inner conductor to provide a body such as illustrated in FIG. 3.
Figure 4B:
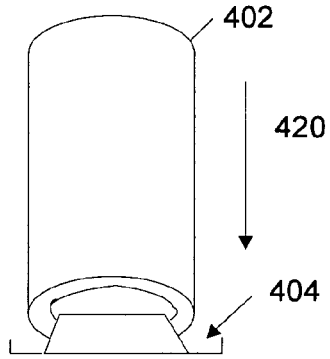
Figure 4C:
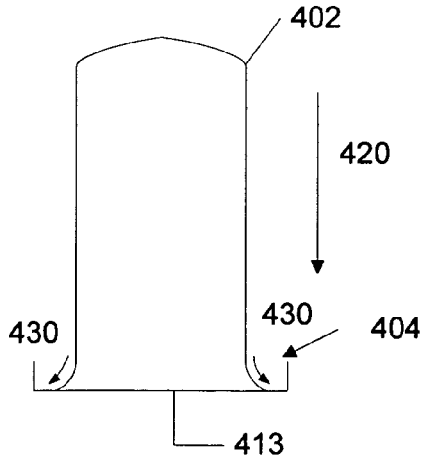

FIGS. 4A, 4B, and 4C illustrate apparatus and operations of a technique for making an integral flange on an inner conductor to provide a body such as illustrated in FIG. 3. FIG. 4A shows a conductive body 402 of a starting configuration positioned over a flanging tool 404. In FIGS. 4A–4C, the conductive body 402 is a generally cylindrical tube or pipe, but it should be understood that the conductive body 402 could be other elongated shapes, for example, a square or oval-shaped extrusion. The flanging tool 404 is adapted to conform to and flange the conductive body 402. That is, the top end of the tool closest to the body has a shape that is adapted to receive the open end of the body. For example, the FIG. 4 body 402 has a cylindrical shape and the flanging tool has a generally circular circumference whose diameter gradually increases with distance away from the top end of the tool.

In the example shown in FIG. 4A, the flanging tool 404 has a first end 406 with a first diameter 408 and a second end 410 with a second diameter 412, and a base 413. In the illustrated example, the diameter 408 of the first end 406 of the flanging tool is smaller than an inner diameter 414 of the conductive body 402, and the diameter 412 of the second end 410 of the flanging tool is larger than an outer diameter 416 of the conductive body 402.

The flanging tool shown in FIG. 4A is adapted to conform to and flange the tubular body 402, but it should be understood that the tool would be differently shaped according to the shape of the corresponding conductive body, and can be adapted to provide other desired features in the produced conductive body. For example, the flanging tool can be made with vanes, or other surfaces that can receive the conductive body and flare the end of the body into a flange. A vaned flanging tool would not present a continuous surface over which the conductive body would be pressed and flared, but would use longitudinal vanes to direct the flaring of the conductive body.

In FIG. 4B, the conductive body 402 has been moved relative to the flanging tool 404 in a direction 420 so that the first end 406 of the flanging tool 404 enters the inner diameter 414 of the conductive body 402. In FIG. 4C, the conductive body 402 has been pressed over the flanging tool 404, causing the end of the conductive body 402 to expand outwardly onto the base 413 of the flanging tool 404. The conductive body 402 is pressed over the flanging tool 404 to continue the outward expansion until the end of the conductive body has expanded outwardly a desired distance to provide a resonator capacitive surface area for the intended resonator operating frequency. If desired, the flange formed on the end of the conductive body 402 can be trimmer or cut, such as with a punch, so that the flange has a desired size and shape.

Figure 5A:
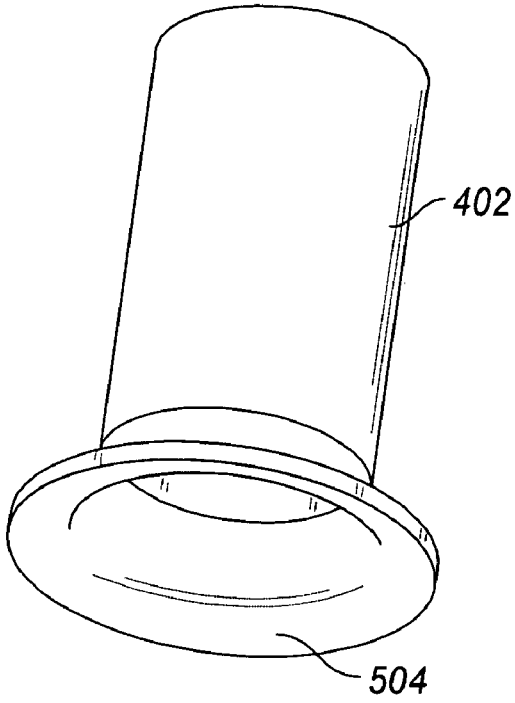
FIGS. 5A, 5B, 6, 7, and 8 are views of conductive bodies with flanges integrally formed using the operations of FIGS. 4A, 4B, and 4C.

FIG. 5A illustrates an example of a flange formed on the end of a conductive body 402 using the technique illustrated in FIGS. 4A–4C. As shown in FIG. 5A, the conductive body 402 has a flange 504 on one end. In the example shown in FIG. 5A, the flange 504 has a curved surface extending from the conductive body to the circumference of the flange.

Figure 5B:
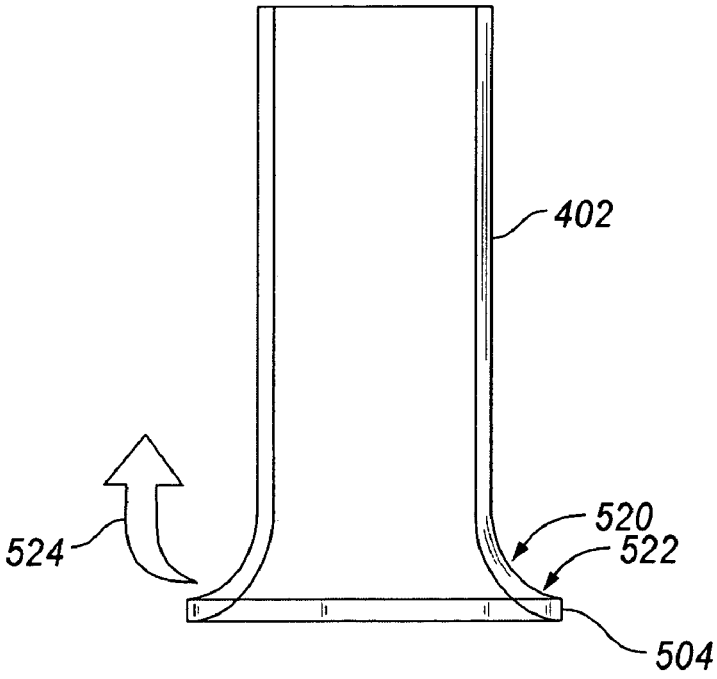

FIG. 5B illustrates a cross-section view of the curved surface flange 504. As shown in FIG. 5B, the curved surface of the flange 504 can include more than one radius depending on the type of flanging tool 404 that is used during the flanging process. For example, in FIG. 5B the conductive body flange curvature follows a first radius of curvature 520 that changes to a different radius of curvature 522 nearer to the outer edge of the flange 504. In other embodiments, the outer edge of the flange 504 can follow a radius so that the edge of the flange is curved in a direction indicated by the arrow 524 (FIG. 5B) that is backward from the direction 420 of pressing. That is, the flange can comprise a surface that is curved backward on itself. Having the edge of the flange curved backwards on itself can be advantageous when the conductive body is used in a resonator because the backward curve might decrease the possibility of arcing between the edge of the flange and the resonator body.

Figure 6:
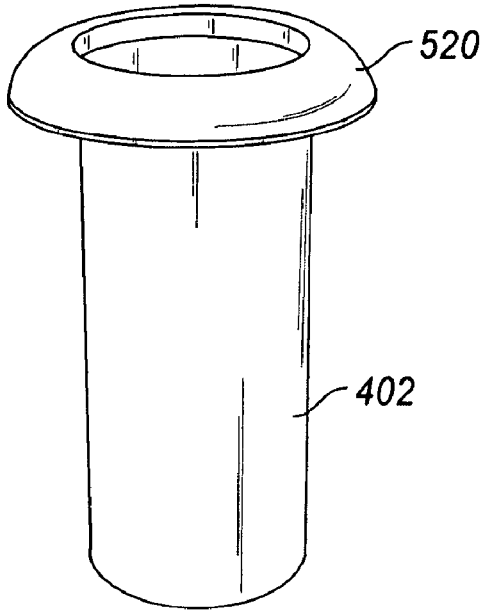

FIG. 6 is a diagram of a flanged conductive body with the flange formed using the technique of FIGS. 4A, 4B, 4C so that the body is curved backward on itself. As shown in FIG. 6, the body includes an elongated conductive body 402 and a backward curved flange 520.

Figure 7:
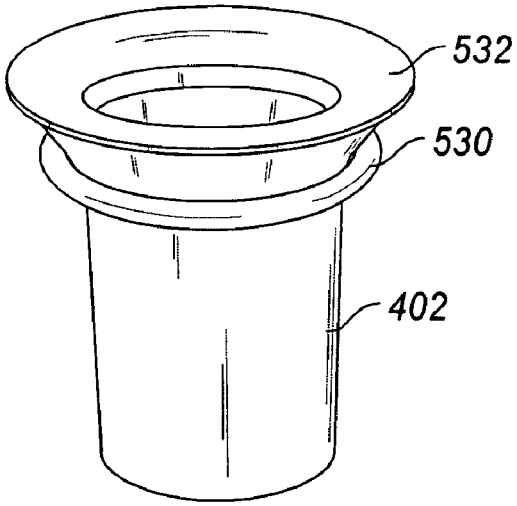
Figure 8:
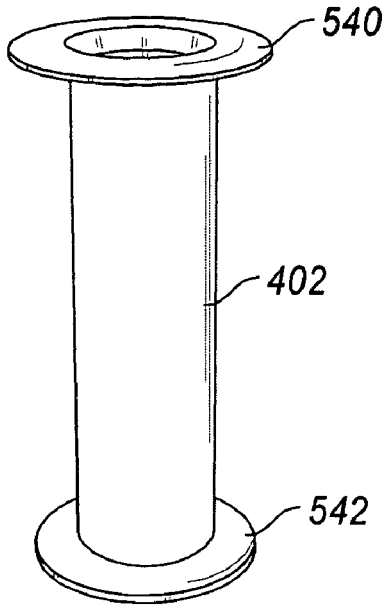

FIG. 7 is a diagram of a double flanged conductive body constructed in accordance with the technique depicted in FIG. 4A, 4B, 4C. As shown in FIG. 7, a conductive body 402 has two flanges 530 and 532 formed on the same end of the conductive body. FIG. 8 is a diagram of a conductive body 402 with a first flange 540 on a first end of the conductive body and a second flange 542 formed on a second end of the conductive body, opposite the first end, using the technique illustrated in FIGS. 4A, 4B, 4C.

FIGS. 9A–E illustrate a technique for making a planar flange on an inner conductor of a coaxial resonator. A conductive body 602 is inserted into an opening 604 of a guide tool 606. In the example illustrated in FIGS. 9A–D, the conductive body 602 is cylindrical. As noted above, however, the conductive body can be any desired shape.

Figure 9A:
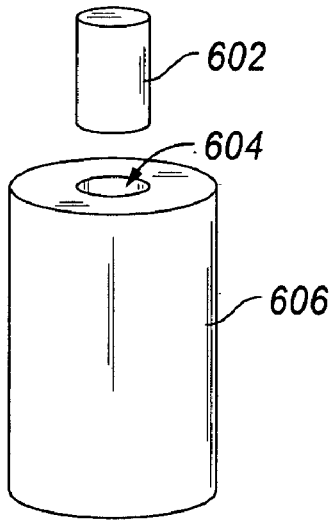
FIGS. 9A, 9B, 9C, 9D, and 9E illustrate apparatus and operations of a technique for making a planar flange on an inner conductive body in accordance with the invention.
Figure 9B:
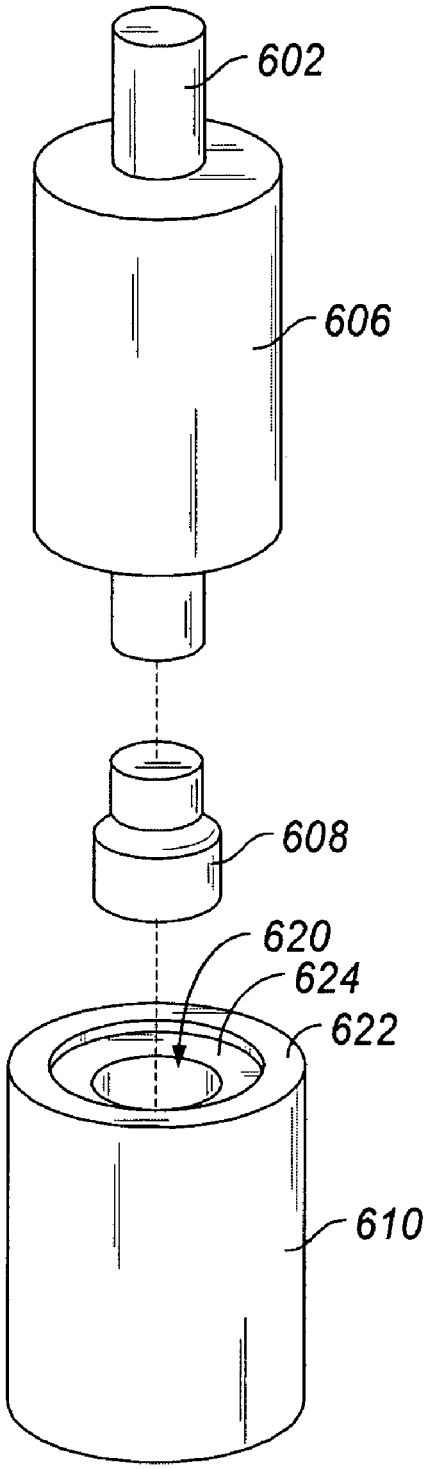

In FIG. 9B, the conductive body 602 is shown inserted through, and extending out of, the guide tool 606. Also illustrated in FIG. 9B is an expanding tool 608 and a calibration tool 610. The expanding tool 608 is inserted within a center opening 620 of the calibration tool 610. A ridge that extends around the center opening 620 of the calibration tool 610 forms a collar 622. The collar 622 forms a stepped surface 624 that is displaced from the top surface of the calibration tool by a desired amount, for example, an amount equal to the wall thickness of the conductive body 602. The diameter and shape of the collar 622 and of the stepped surface 624 are used to control the size and shape of the flange that will be formed on the end of the conductive body 602.

Figure 9C:
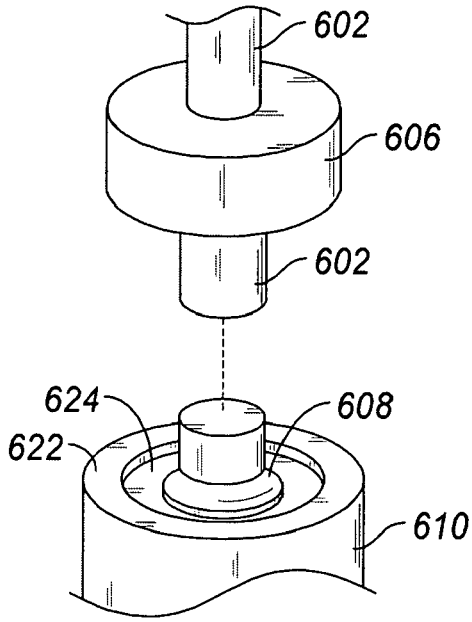
Figure 9D:
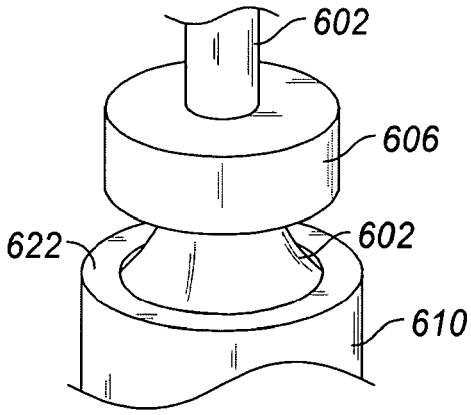
Figure 9E:
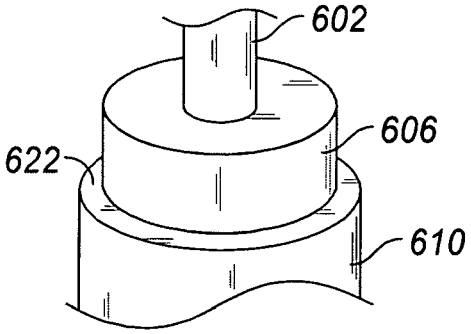

FIG. 9C shows the conductive body 602 as it is pressed over the expanding tool 608, flaring the end of the conductive body 602. The pressing action forces the conductive body 602 onto the stepped surface 624 and against the collar 622 of the calibration tool 610. FIG. 9D shows the conductive body 602 pressed over the expanding tool 608 and onto the stepped surface 624 and out to the collar 622 of the calibration tool 610. After the conductive body 602 has been shaped so that the flange has a size of the desired amount, the conductive body is withdrawn from the calibration tool 610 and the expanding tool 608 is removed from the calibration tool 610. The flanged conductive body 602 is then placed back onto the stepped surface 624 inside the collar 622 of the calibration tool 610 for finishing. As shown in FIG. 9E, the guide tool 606 is then pressed down onto the flanged area of the conductive body 602, thereby flattening the flange into a desired transverse planar surface and forming a substantially right angle transition from the length of the conductive body to the flange surface. If a flared (curved) end is suitable, rather than a right angle transverse flanged surface, then the guide tool operation of FIG. 9E can be omitted.

In another embodiment, a process similar to that illustrated in FIGS. 9A–E is performed with a calibration tool 610 that does not have a collar 622. The inner conductor body 602 is pressed over the expanding tool 608 and onto the surface 624, which no longer has a stepped configuration because of the removal of the collar 622. As described above, after the conductive body 602 has been shaped with a flange, it is withdrawn from the calibration tool 610 and the expanding tool 608 is removed. The flanged conductive body 602 is then placed back onto the calibration tool 610 and the guide tool 606 is then pressed down onto the flange area of the conductive body 602, thereby flattening the flange into a desired transverse planar surface. The flange is then trimmed to a desired size and shape, such as with a punch that cuts around the periphery of the transverse planar surface. The punch can be a separate tool, or it can be part of the guide tool 606 so that the flange can be flattened and trimmed in a single operation. For example, the lower edge of the guide tool 606 can be provided with a cutting rim.

Figure 10:
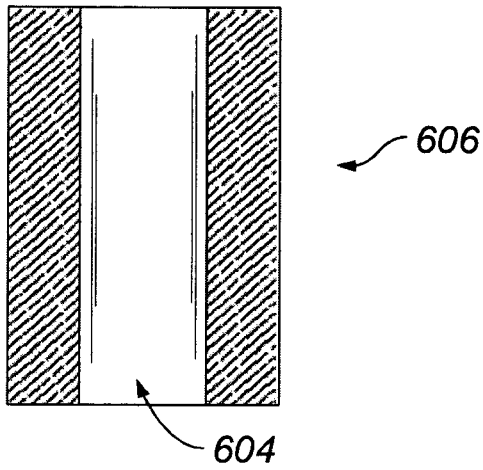
FIG. 10 is a cross section of a guide tool used in the operations of FIGS. 9A–9E.
Figure 11:
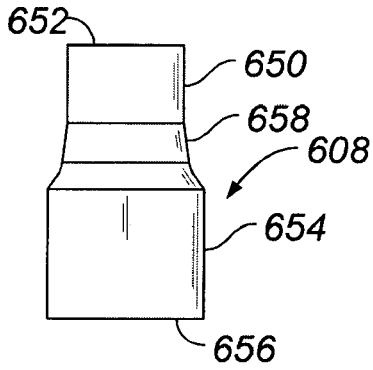
FIG. 11 is a cross section view of an expanding tool used in the operations of FIGS. 6A–6E.
Figure 12:
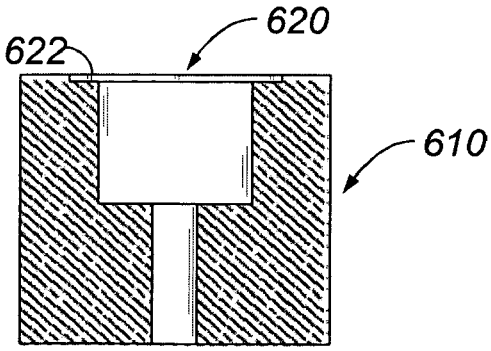
FIGS. 12, 13, 14A, 14B, 15A, and 15B are cross section views of a calibration tool used in the operations of FIGS. 9A–9E.

FIGS. 10, 11, and 12 show detailed cross-sectional views of exemplary tools used for forming a flanged inner conductor as shown in FIGS. 9A–E. FIG. 10 is a cross section of the guide tool 606. An opening 604 in the guide tool 606 is adapted to receive a conductive body. FIG. 11 is a cross section view of the expanding tool 608. The exemplary expanding tool shown in FIG. 11 has a first end 650 with a first diameter 652 and a second end 654 with a second diameter 656. A sloping surface 658 extends from the first end 650 diameter to the second end 654 diameter. The diameter of the first end is configured to fit within an inner diameter of a conductive body, and the second diameter is configured to be suitable for expanding the conductive body into a flange when the body is pressed over the tool. FIG. 12 is a cross section of an embodiment of the calibration tool 610. The calibration tool 610 includes an opening 620 adapted to accept the second end 654 of the expanding tool 608. The calibration tool 610 also includes a collar 622 adapted to accept the end of the conductive body as it is expanded.

Figure 13:
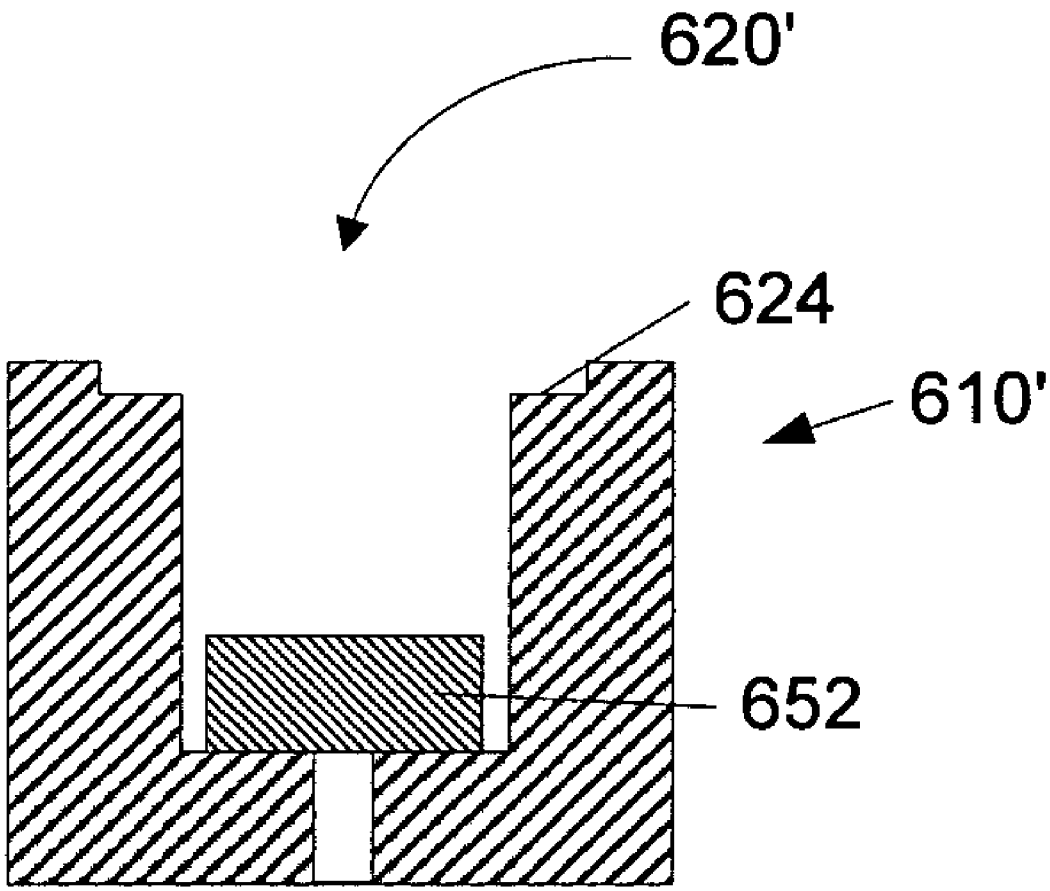

FIG. 13 is a cross section of another embodiment of the calibration tool. In the FIG. 13 embodiment of the calibration tool 610', there is an opening 620' in the calibration tool 610' adapted to receive a retractable support 652. The retractable support 652 is used to located the expanding tool 608 a desired distance from the stepped surface 624 of the calibration tool 610'. When used in making planar flanges on an inner conductor of a coaxial resonator, the support 652 is positioned to accept the expanding tool 608. As the conductive body 602 is pressed over the expanding tool 608, the support 652 exerts sufficient force to maintain the expanding tool 608 in a desired position. After the conductive body 602 has been flanged a desired amount the expanding tool 608 is not removed. The guide tool 606 is then pressed down onto the flanged area of the conductive body 602. The pressing force of the guide tool 606 used to form a planar transverse surface is sufficient to overcome the force exerted by the support 652, and the expanding tool 608 moves down into the opening 620' of the calibration tool 610'. The movement of the expanding tool 608 down into the opening 620' permits flattening the flange into a desired transverse planar surface. The support 652 can be, for example, a spring, a pneumatic electric or magnetic actuator, or other device that can hold the expanding tool in a desired location during the pressing of the conductive body 602 to form a desired flange and then to allow the expanding tool to move out of the way during the pressing of the guide tool to form a planar surface. The retractable calibration tool 610' can be used in place of the tool 610 shown in FIGS. 9B–9E and 12. A similar substitution applies for the calibration tools in the following description.

Figure 14A:
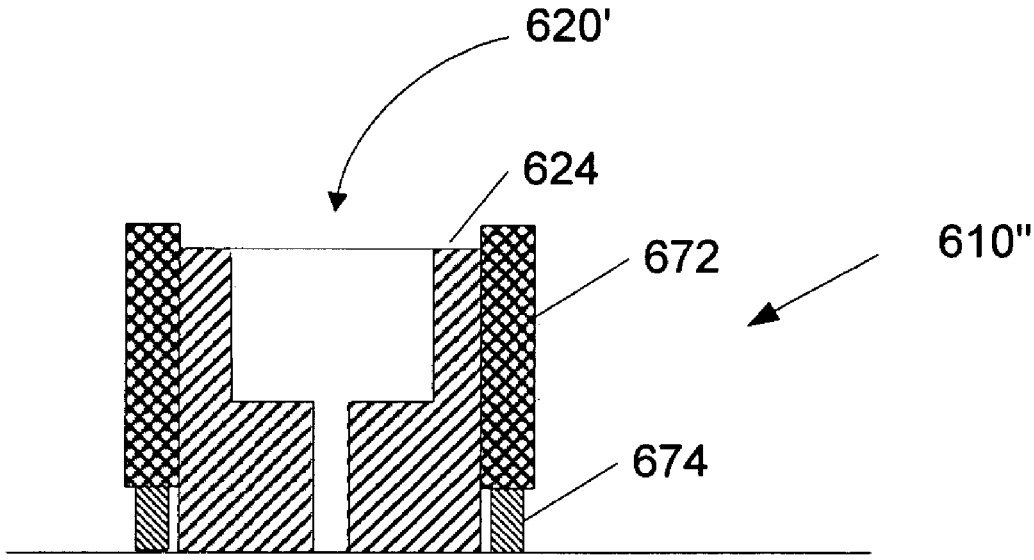
Figure 14B:
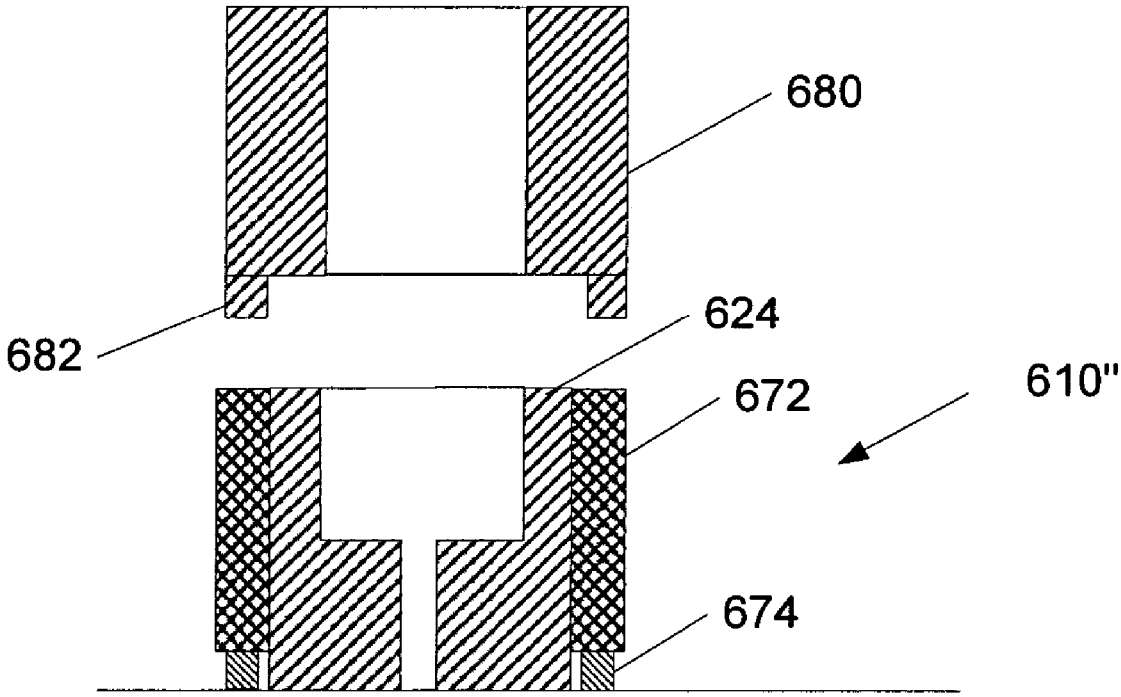

FIGS. 14A–B illustrate yet another embodiment of the calibration tool. In the FIG. 14A embodiment of the calibration tool 610", an annular disk or cylinder 672 extends around the outer surface of the calibration tool 610". The annular disk 672 can be located in a desired position by a retractable support 674. In FIG. 14A the retractable support 674 elevates the annular disk 672 so it comprises a collar that extends around the center opening 620' of the calibration tool 610", forming a stepped surface 624. The calibration tool 610" can be used in the process of forming a planar flange on an inner conductor of a coaxial resonator, as described in the discussion of FIGS. 9A–D. After the conductive body has been pressed over the expanding tool onto the stepped surface 624 and outwardly toward the collar formed by the raised annular disk 672, as described in the discussion of FIGS. 9A–D, the flanged conductive body is removed from the calibration tool 610" and the expanding tool is removed. The flanged conductive body is then placed back onto the stepped surface 624 of the calibration tool 610".

FIG. 14B shows the calibration tool 610" when a guide tool is pressed down onto the flanged area of the conductive body. As shown in FIG. 14B the annular disk 672 has been retracted so that it is level with, or slightly below, the stepped surface 624. Retracting the annular disk 672 can result in greater flattening of the flange into a desired transverse planar surface and forming a nearly right angle transition from the length of the conductive body to the flange surface.

In the embodiment of FIGS. 14A–14B, retracting the annular disk 672 is performed by the retractable support 674. The retractable support 674 can be, for example, a mechanical, pneumatic, electric, or magnetic actuator, or other device that can hold the annular disk 672 in a desired location during the pressing of the conductive body to form a desired flange, and can then move the annular disk 672 during the pressing of the guide tool to form a planar surface.

For example, the retractable support 674 can be a spring. In such a configuration, a modified guide tool 680 has a tip 682 extending along its outer diameter and can push the annular disk 672 down during the flattening operation, as illustrated in FIG. 14B. As noted, the calibration tool 610" can be used in place of the tool 610 shown in FIGS. 9B–9E and 12. A similar substitution can apply for the calibration tools in the following description.

Figure 15A:
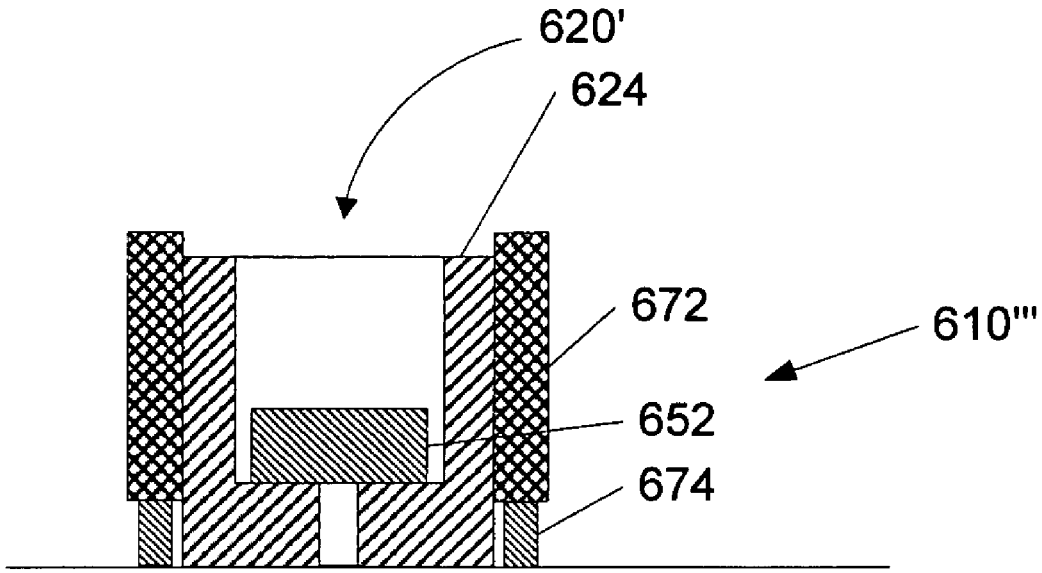
Figure 15B:
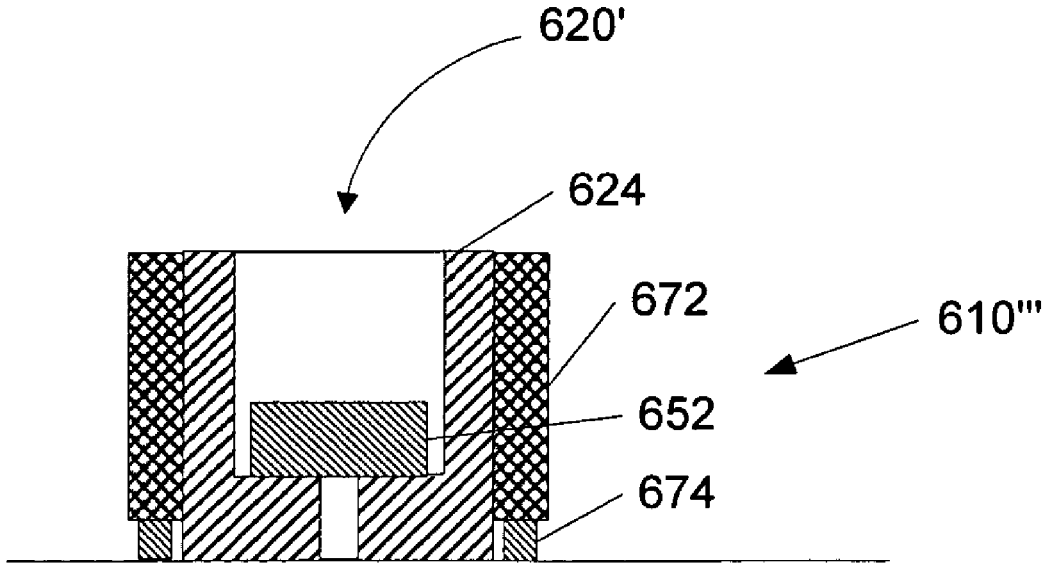

FIGS. 15A–B illustrate still another embodiment of the calibration tool. In the FIG. 15A embodiment of the calibration tool 610''', the operation of the annular disk 672 and supporting member 674 is similar to the description of FIGS. 14A–B. The FIG. 15A embodiment includes the retractable support 652 located in the opening 620' of the calibration tool 610'''. As described in the discussion of FIG. 13, the retractable support 652 allows the expanding tool to move further into the opening 620' of the calibration tool 610''' and out of the way during the flattening of the flange on the end of the conductive body into a desired transverse planar surface. Thus, the calibration tool 610''' shown in FIGS. 15A–B can be used to form a substantially right angle (90 degree) transition from the length of the conductive body to the flange surface without removal of the conductive body from the calibration tool 610''' to remove the expanding tool. As noted above, the calibration tool 610''' can be used in place of the tool 610 shown in FIGS. 9B–9E and 12. A similar substitution applies for the calibration tools in the following description.

Figure 16:
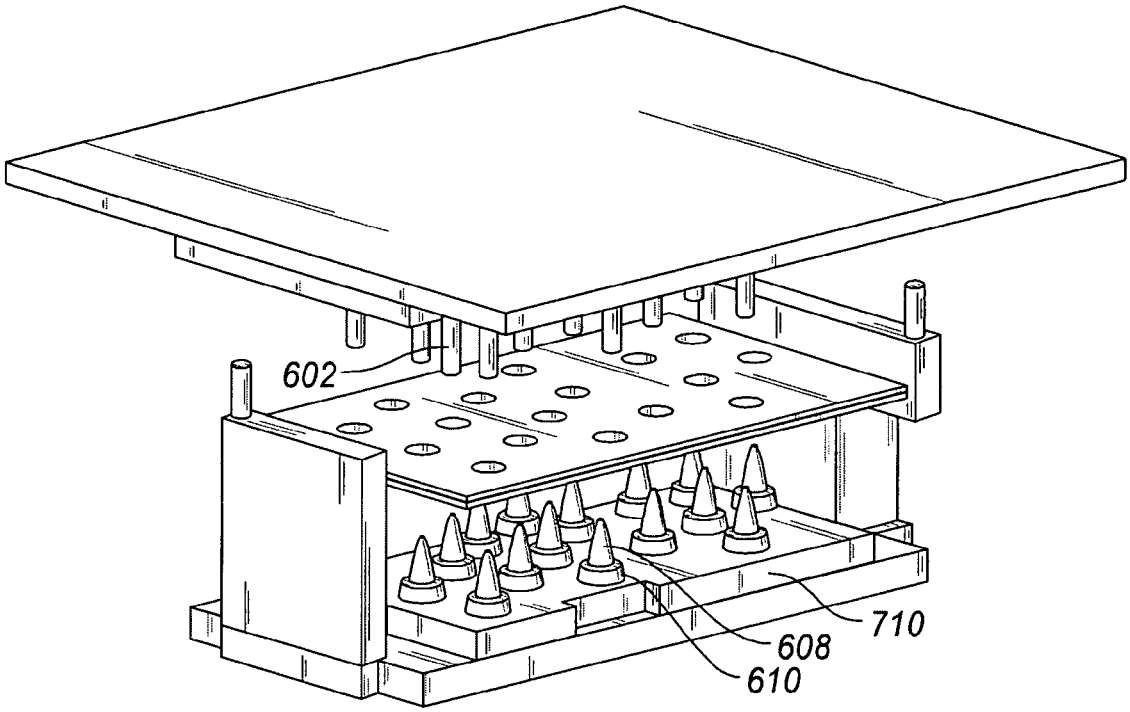
FIG. 16 is an illustration of a tooling fixture that can be used to simultaneously produce multiple flanged conductive bodies in accordance with the invention.

FIG. 16 illustrates a tooling fixture that can be used to simultaneously produce multiple flanged conductive bodies. As shown in FIG. 16, a tooling plate 710 includes an array of calibration tools 610, each with an expanding tool 608 inserted. An array of conductive bodies 602 are aligned and pressed over the corresponding expanding tools 608 and onto the calibration tools 610. A procedure similar to that described in connection with FIGS. 9A–E is performed to make an array of flanged inner conductors. Using different calibration tools 610 and expanding tools 608 within the array allows inner conductors with different types of flanges to be made at the same time. For example, some of the calibration tools 610 can have collars that are of different sizes and therefore produce different sized flanges. Also, different types of conductive bodies can be used with the calibration tools 610 and expanding tools 608 to make flanged inner conductors that are of different shapes. In addition, by varying the height of the calibration tool, flanged inner conductors of various lengths can be made.

Figure 17:
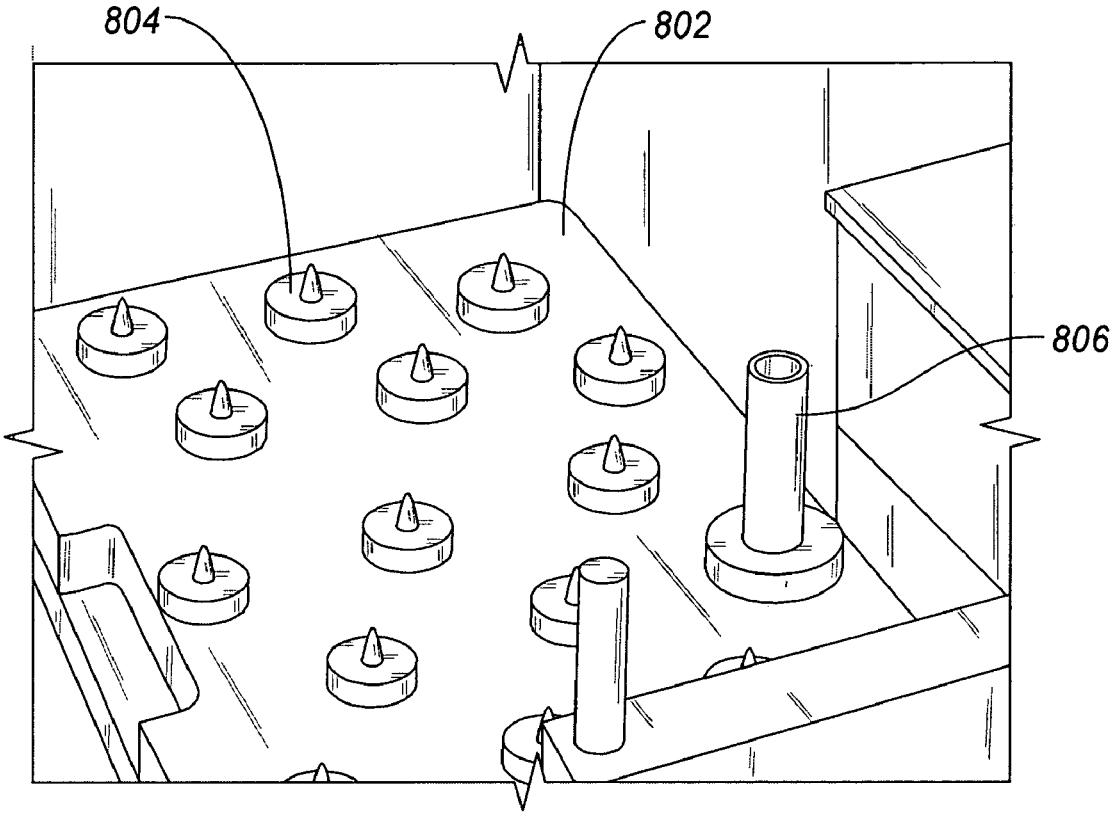
FIG. 17 is an illustration of tooling that can be used with the FIG. 16 fixture to install flanged inner conductors into resonator cavities.

FIG. 17 illustrates tooling that can be used when installing a flanged inner conductor into a cavity of a resonator housing. As shown in FIG. 17, a clamping fixture 802 includes an array of spacers 804 located on the clamping fixture, each corresponding to a desired location within the resonator cavity. Flanged inner conductors 806 are placed on the spacers 804 with the flanged end of the inner connector in contact with the spacer 804. A resonator housing is then placed over the inner conductors 806 so that the end of the inner conductor opposite the flanged end is in contact with the inner surface of a corresponding housing cavity. The inner conductors are then attached to the cavity surface (bottom wall of the housing). It is noted that inner conductors or various lengths can be installed with the clamping fixture 802 by varying the height of the corresponding spacers 804, such that the exposed inner conductor ends are substantially coplanar and mate with the housing bottom wall.

Figure 18A:
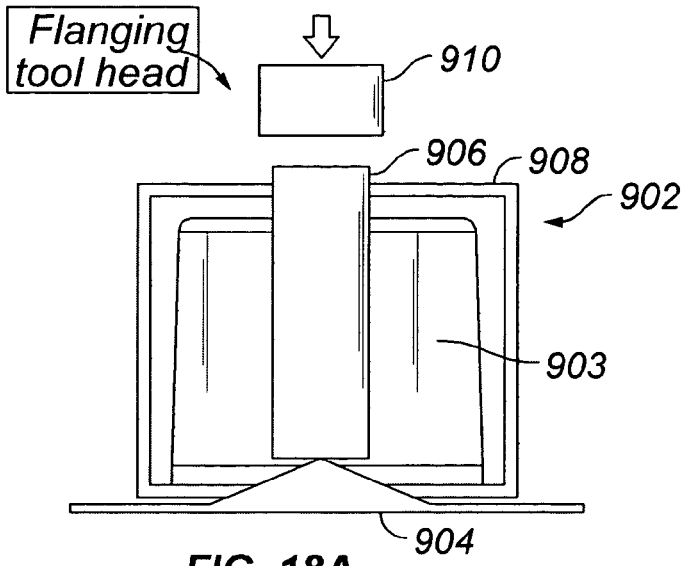
FIGS. 18A, 18B, and 18C illustrate apparatus and operations used in a technique of simultaneously flanging an inner conductor and attaching the inner conductor to a cavity in accordance with the invention.
Figure 18B:
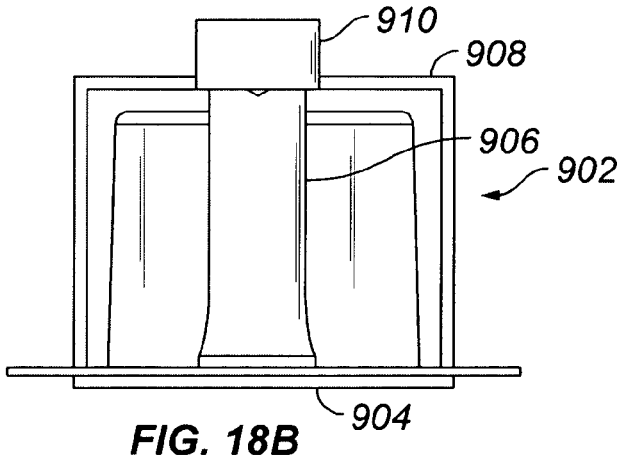
Figure 18C:
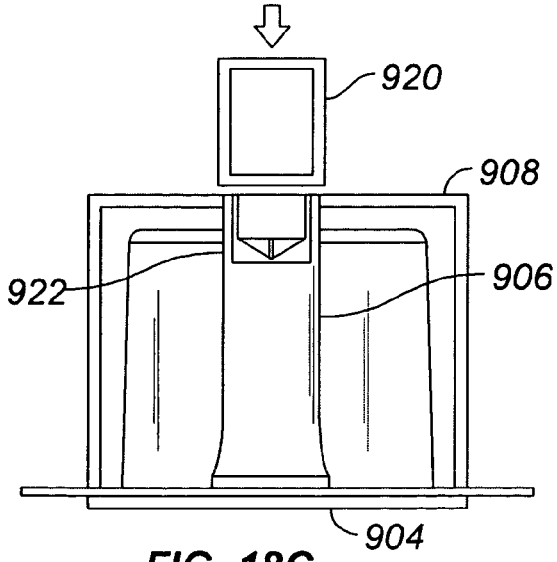

FIGS. 18A–C illustrate a technique of simultaneously flanging an inner conductor and attaching the inner conductor to a resonator cavity, in the same procedure. FIG. 18A illustrates a housing 902 with a resonator cavity 903 that is placed over a flanging tool 904. The flanging tool head is similar to the flanging tool 404 described above in connection with FIGS. 4A–C. A conductive body 906 is inserted through a hole in the cavity wall 908 and is positioned onto the flanging tool 904. A flanging tool head 910 is placed on the an end of the conductive body 906 that extends out of the cavity wall 908. The flanging tool head 910 is pressed downward, forcing the conductive body 906 over the flanging tool 904. In a manner similar to the description in connection with FIGS. 4A–C, a flange is formed on the end of the conductive body 906 during the pressing process.

FIG. 18B shows the housing 902 with the flanged conductive body 906. After a flange is formed on the conductive body, the opposite end of the conductive body 906 that was not flanged will be positioned flush with the outer surface of the cavity wall 908.

FIG. 18C illustrates attaching the flanged conductive body 906 to the cavity wall 908. After the conductive body has been flanged, the flanging tool head 910 is removed and a riveting tool head 920 is placed above the end of the conductive body 906 that is flush with the cavity wall 908. The riveting tool head 920 installs a rivet 922 into the conductive body 906, thereby securing the conductive body 906 to the cavity wall 908.

Figure 19:
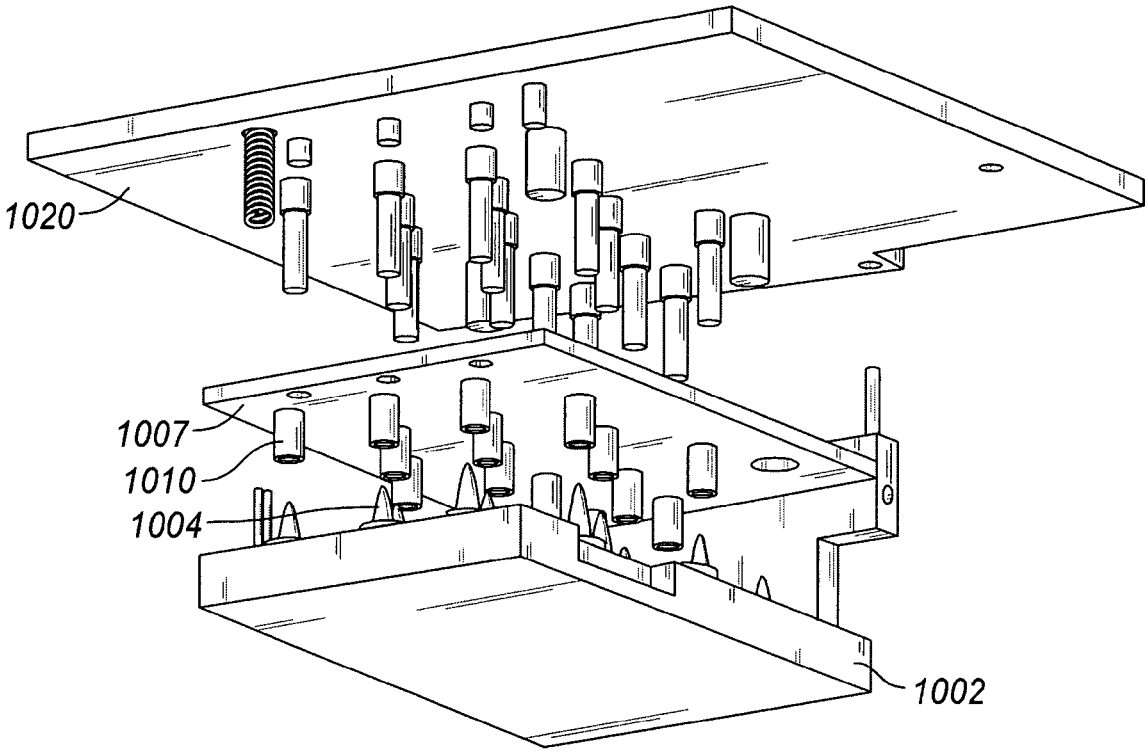
FIG. 19 illustrates an exploded view of apparatus used in a technique of simultaneously flanging an array of conductive bodies and attaching them in corresponding resonator cavities in accordance with the invention.

FIG. 19 illustrates a technique of flanging an array of inner conductors and attaching the flanged conductors to a resonator housing in the same procedure. FIG. 19 shows a tooling plate 1002. Located on the tooling plate 1002 is an array of upwardly extending flanging tools 1004. The array of flanging tools is arranged to align with a corresponding desired pattern of inner conductors 1010 within a base 1007 of a resonator housing (the resonator housing is not shown for clarity). In the FIG. 19 example, the base 1007 includes a plurality flanged conductors affixed corresponding to respective cavities in the resonator housing.

The base 1007 is placed onto the tooling plate 1002 and is positioned so that holes in the base 1007 correspond to the locations of the inner conductors 1010 align with the flanging tools 1004. The inner conductors 1010 are then inserted through the holes in the base 1007 and onto the corresponding flanging tool 1004 with a pressing tool 1020. In FIG. 19, the resonator housing is inverted from its normal operational orientation, so that the conductors 1010 are arranged beneath the base 1007 of the resonator housing. After pressing, the housing can be inverted for final assembly, including attachment of a top wall, or lid. A procedure similar to that described in connection with FIGS. 18A–18C is followed, except that all of the inner conductors are flanged and riveted at the same time. This procedure flanges and rivets all of the inner conductors in the resonator with only two pressing motions, greatly improving production efficiency.

Figure 20:
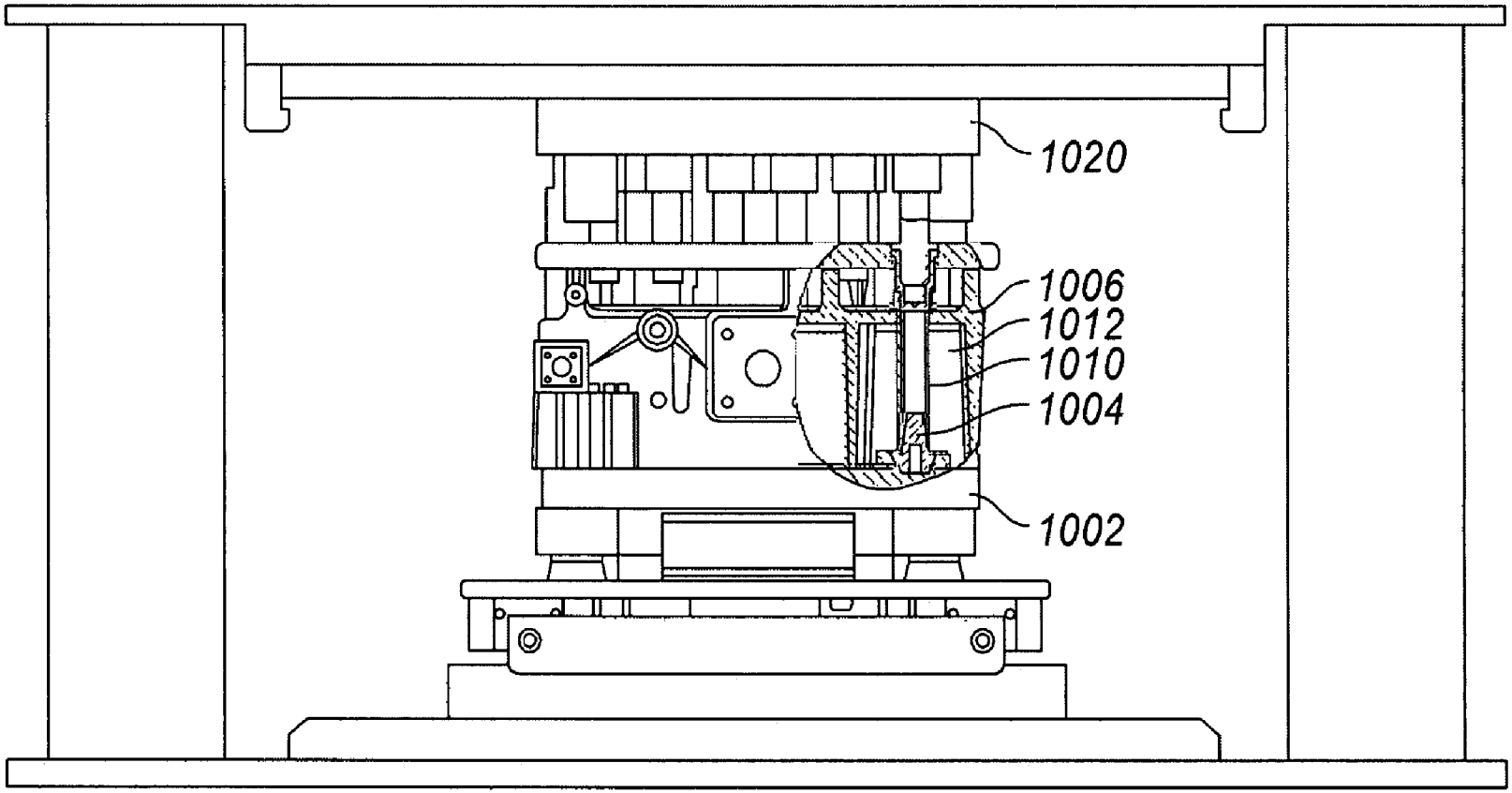
FIG. 20 is a side elevation view, with a cut away section, of resonator housing in accordance with the invention.

FIG. 20 is a side elevation view, with a cut away section, of a resonator housing 1006 that can be used in the techniques described in FIG. 19. The cut away view of FIG. 20 shows one internal cavity 1012 of the resonator housing 1006. The resonator housing is positioned above a tooling plate 1002 that includes a plurality of flanging tools 1004 that align with cavities within the resonator housing 1006. Inside the cavities 1012 there are at least one of the plurality of flanging tools 1004 and one or more corresponding conductive bodies 1010. After the resonator housing 1006 is positioned so the inner conductors 1010 align with the corresponding flanging tools 1004, a press 1020 forces the plurality of inner conductors over the flanging tools 1004 until a desired flange is formed on the end of the inner conductors 1010.

Figure 21:
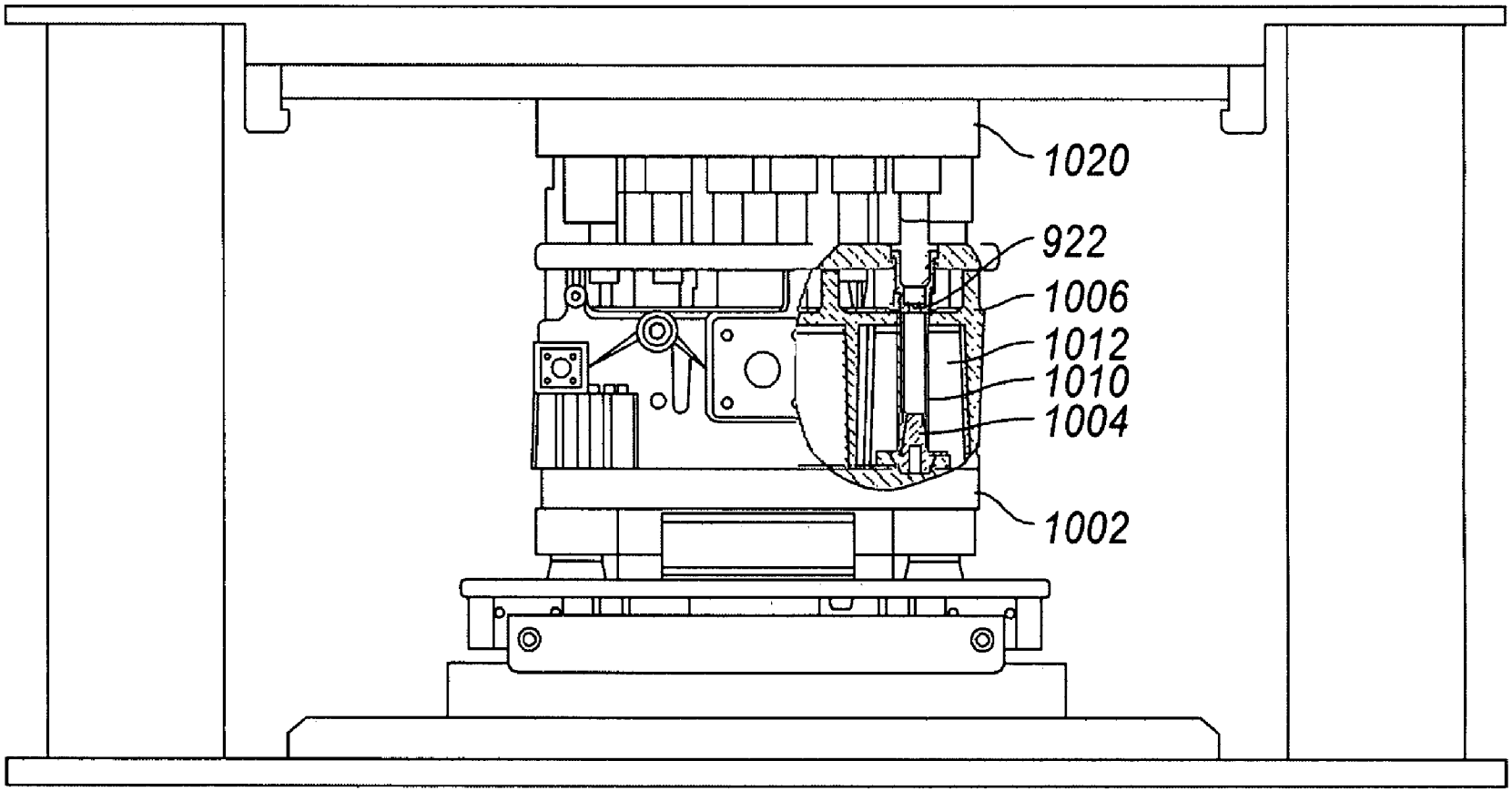
FIG. 21 is a side elevation view, with a cut away section, of resonator housing in accordance with the invention.

FIG. 21 is a side elevation view, with a cut away section, of the resonator housing 1006, similar to that shown in FIG. 20, that can be used in the techniques described in FIG. 19. FIG. 21 shows a cut away view of one internal cavity 1012 of the resonator housing 1006. The inner conductors 1010 are located inside the cavities 1012 following the flanging process described in connection with FIG. 20. After the inner conductors 1010 have been flanged, the press 1020 is moved away and a rivet 922 is positioned within the end of each inner conductor 1010. The press 1020 then presses the rivet 922 to secure each inner conductor 1010 to the resonator housing 1006.

Figure 22:
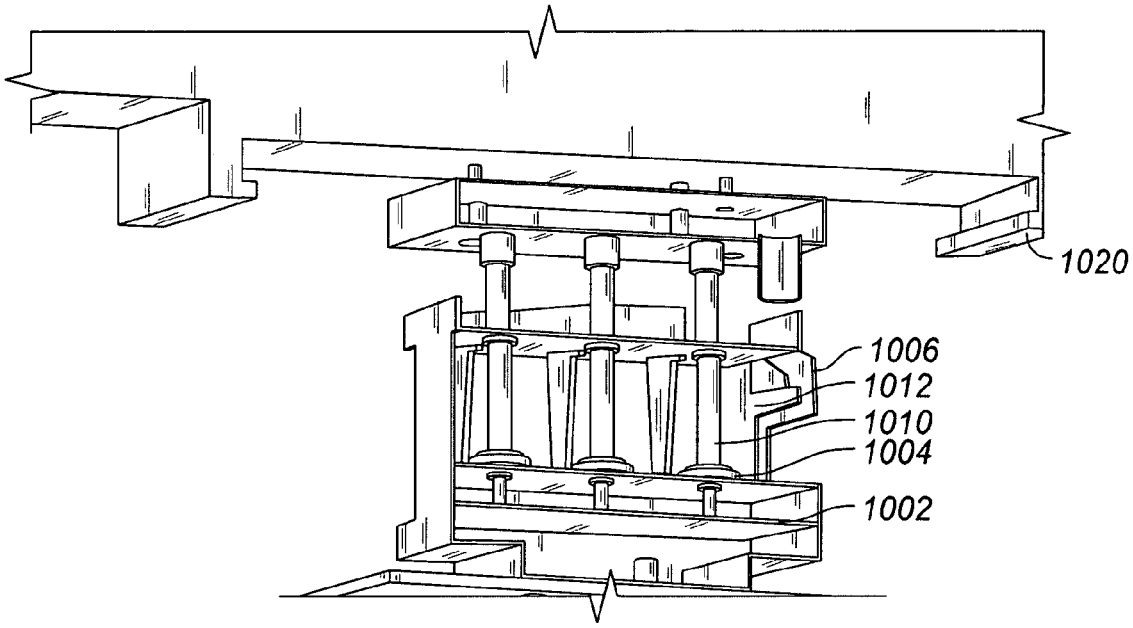
FIG. 22 is a side elevation view, with a cut away section, of resonator housing in accordance with the invention.

FIG. 22 is a perspective cross section of the resonator housing 1006. As shown in FIG. 22, the resonator housing 1006 is located above the tooling plate 1002, which includes a plurality of expanding tools 1004. The inner conductors 1010 are located within inner cavities 1012 of the resonator housing 1006. After each inner conductor 1010 is positioned above a corresponding expanding tool 1004, the press 1020 forces the inner conductor over the expanding tool 1004 to form a desired flange on the end of the inner conductor 1010. A rivet (not shown) is then placed in the end of the inner conductor 1010 and the press 1020 presses the rivet so as to attach the inner conductor 1010 to a corresponding resonator body 1006.

Figure 23:
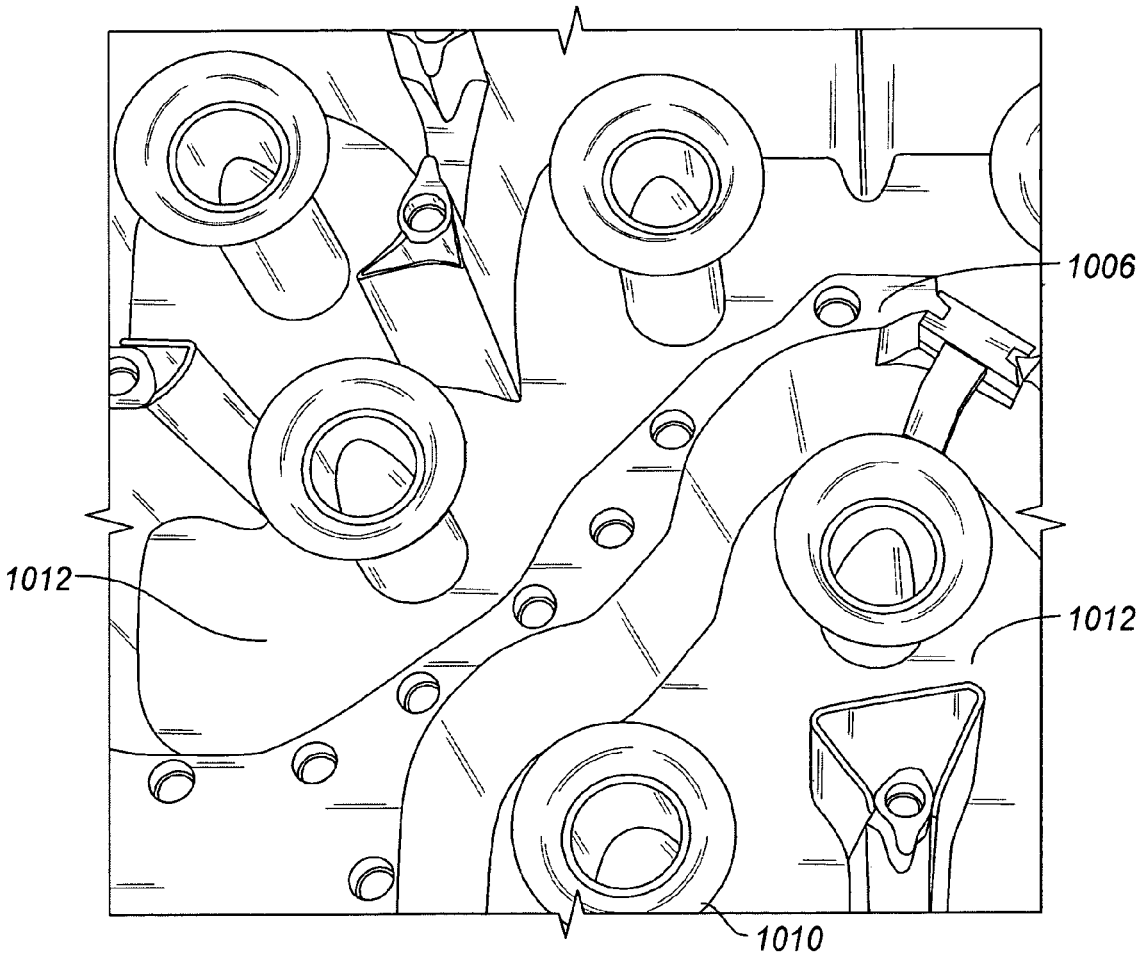
FIG. 23 is a detail view of the conductive bodies formed in accordance with the procedure illustrated in FIG. 19.

FIG. 23 is an illustration of a resonator that is constructed in accordance with the simultaneous flanging and riveting procedure described in FIGS. 19–22. As shown in FIG. 23, the resonator housing 1006 includes a plurality of cavities 1012. Each of the cavities 1012 includes one or more flanged inner conductors 1010. The inner conductors can be formed simultaneously with flanges of different sizes and shapes by installing different corresponding flanging fixtures on the tooling fixture 1002. In addition, inner conductors of various lengths can be produced by adjusting the height of the flanging tools on the flanging fixture 1002. Different shaped extrusions or pipe lengths can be used to make the inner conductors by using a flanging fixture that corresponds to the particular extrusion or pipe selected. In this way, a resonator with different types of inner conductors can be produced in a single manufacturing process.

Figure 24:
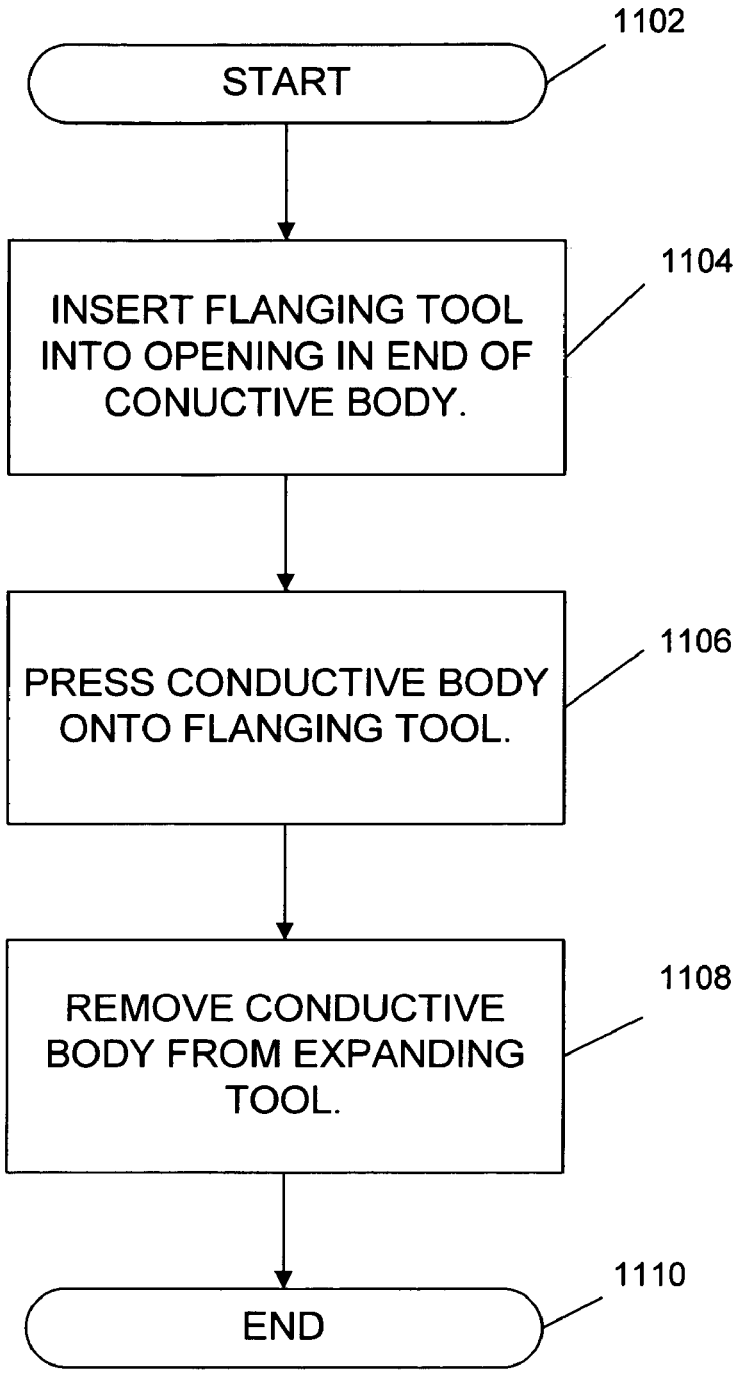
FIG. 24 is a flow diagram illustrating a technique for making a flanged conductive body for use as an inner conductor for use in a resonator.

FIG. 24 is a flow diagram illustrating a technique for making a flanged conductive body that can be used as an inner conductor of a coaxial resonator. The process begins in block 1102, whereupon a flanging tool is inserted into an opening in an end of a conductive body, as indicated by block 1104. At block 1106, relative movement between the flanging tool and the conductive body presses the conductive body onto the flanging tool. As the conductive body is pressed onto the flanging tool, the end of the conductive body expands outwardly a desired distance. At block 1108, the conductive body is removed from the expanding tool. At block 1110 the process ends, leaving a flared, transverse flange at the end of the conductive body.

Figure 25:
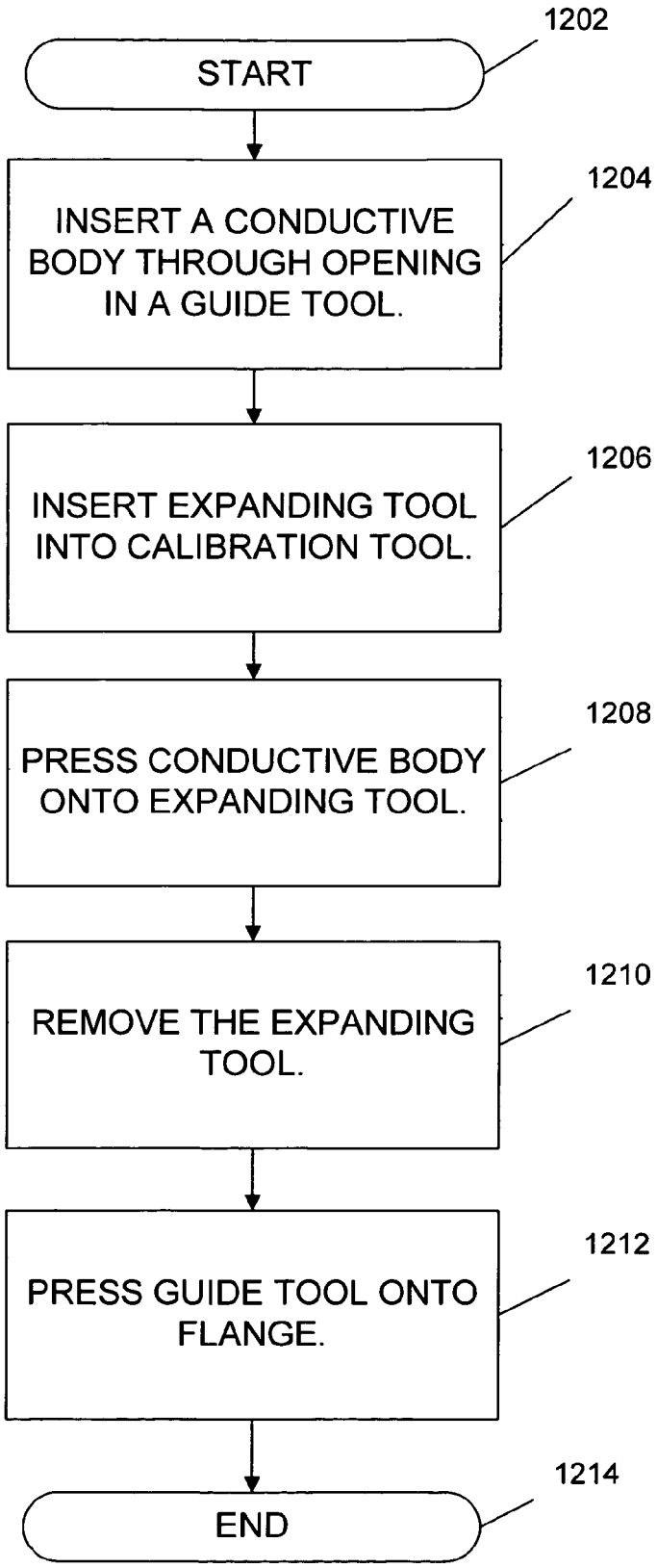
FIGS. 25 and 26 are flow diagrams of other techniques for making a flanged conductive body for use as an inner conductor in a resonator.

FIG. 25 is a flow diagram of another technique for making a flanged conductive body for use as an inner conductor in a coaxial resonator. Process flow begins in block 1202. At block 1204, a conductive body is inserted through an opening in a guide tool. The conductive body is inserted so that an end of the conductive body extends out of the guide tool. At block 1206 an expanding tool is inserted into a calibration tool. The calibration tool includes a collar that is sized to produce a desired flange of the end of the conductive body. See, for example, the calibration tool 610 depicted in FIG. 9B. The process flow continues to block 1208, where the conductive body is pressed onto the expanding tool so that the insertion tool enters into an opening in the end of the conductive body. As the conductive body is pressed, the open end expands outwardly and transversely into the collar of the calibration tool. Pressing of the conductive body continues until a desired flange is formed on the end of the conductive body. At block 1210, the conductive body is lifted out of the calibration tool and the expanding tool is removed from the calibration tool. At block 1212 the conductive body is again placed so that the flange is located against the collar of the calibration tool. The guide tool is then pressed onto the flanged end of the conductive body to shape the flange into a desired generally planar transverse surface. The process flow ends at block 1214.

Figure 26:
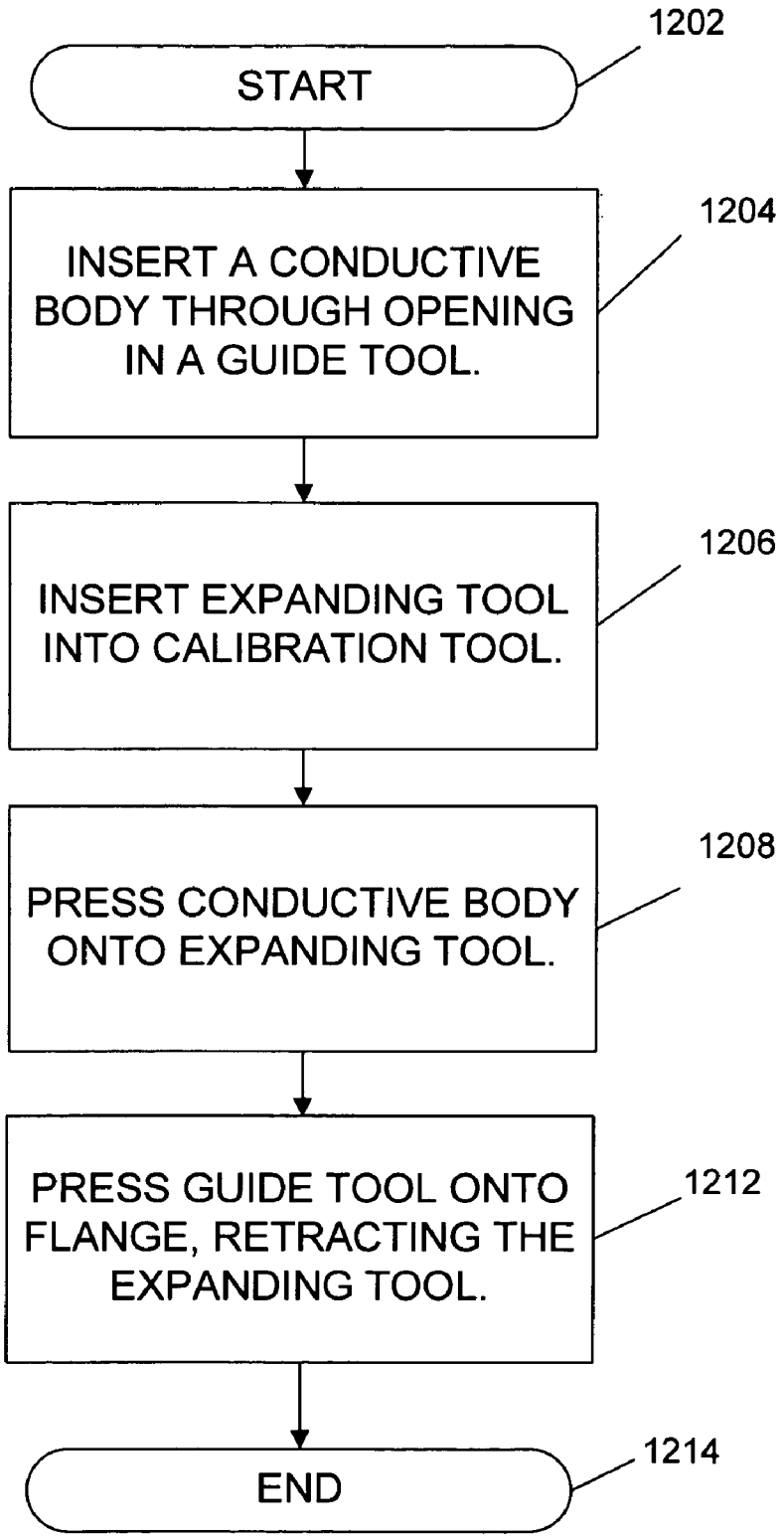

FIG. 26 is a flow diagram of yet another technique for making a flanged conductive body for use as an inner conductor in a coaxial resonator. Process flow in block 1202 through 1208 is the same as described for corresponding blocks in FIG. 20. In the technique of FIG. 26, however, a calibration tool with a retractable support positioning the expanding tool is used. The retractable calibration tool is similar to the tool illustrated in FIG. 13. In FIG. 26, block 1208, after pressing the conductive body until a desired flange is formed on the end of the conductive body, operation continues to block 1212, where the guide tool is pressed onto the flanged end of the conductive body to make a flange with a desired planar surface. The pressing force of the guide tool to make the planar surface is large enough to overcome the retaining force of the support holding the expanding tool in place, such that the expanding tool retracts out of the flange of the conductive body, down into the opening in the calibration tool, thereby forming a planar transverse surface. The process flow ends in block 1214.

Figure 27:
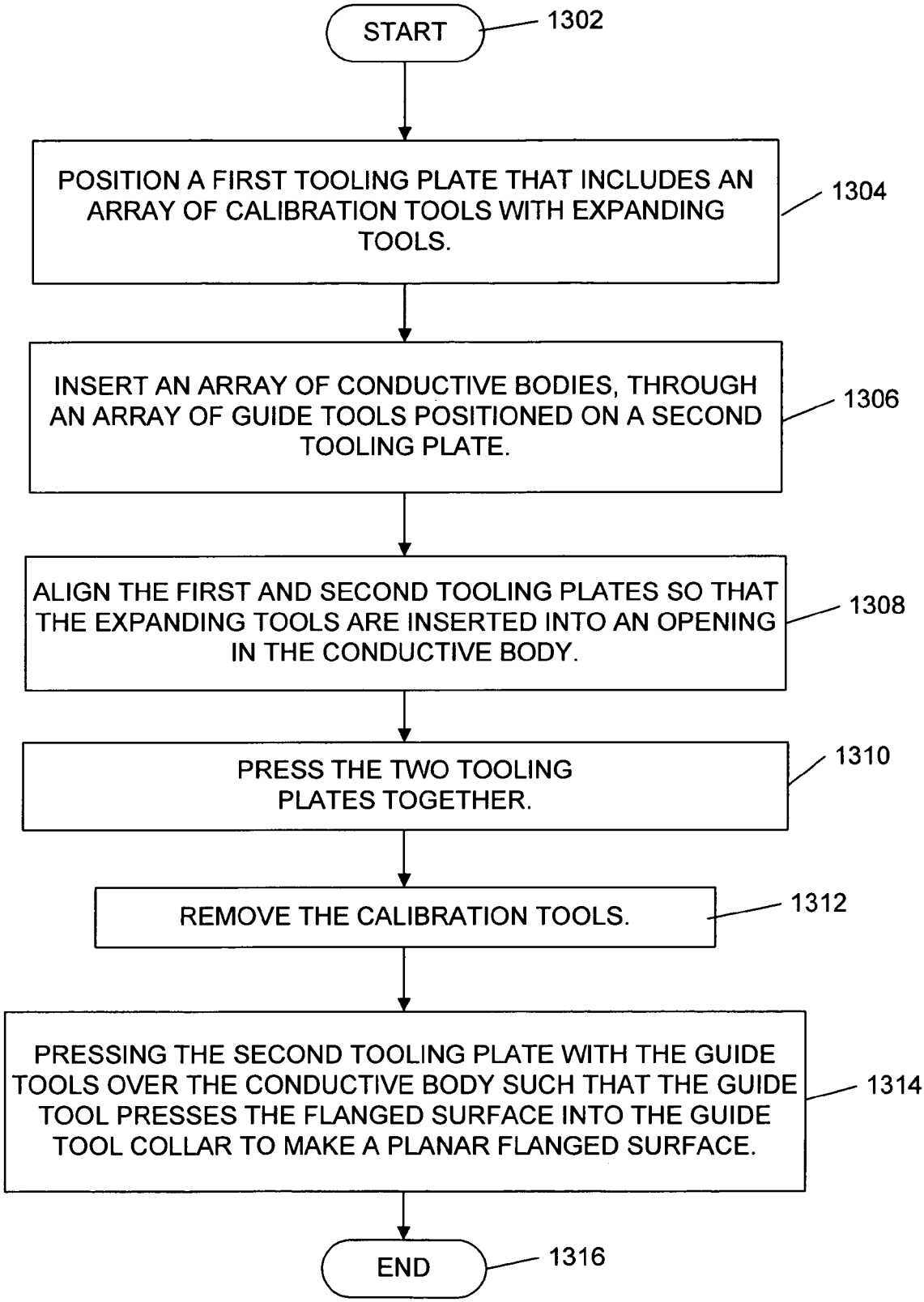
FIGS. 27 and 28 are flow diagrams illustrating techniques that can be used to produce multiple flanged conductive bodies in the same procedure.

FIG. 27 is a flow diagram that represents a technique to simultaneously produce multiple flanged conductive bodies in the same procedure. Process flow starts at block 1302. At block 1304, a first tooling plate is positioned into a press. The first tooling plate includes an array of calibrating tools. Expanding tools are inserted into the calibration tools, as described above. Process flow continues to block 1306, where a plurality of conductive bodies are inserted through an array of guide tools positioned onto a second tooling plate. The locations of the guide tools on the second tooling plate correspond to the locations of the array of calibration tools on the first tooling plate. Process flow continues to block 1308, where the first and second tooling plates are aligned such that the ends of the expanding tools on the first tooling plate are inserted into openings in the ends of the plurality of conductive bodies. Flow continues to block 1310.

At block 1310, the first and second tooling plates are pressed together. The pressing action causes the conductive bodies to expand over the expanding tools, creating a flange in collars of the calibration tools. After flanges of a desired size have been formed on the ends of the conductive bodies, the pressing action stops and the process flow continues to block 1312. At block 1312, the first and second tooling plates are separated, removing the conductive bodies from the calibration tools. The expanding tools are removed from the array of calibration tools. Flow then continues to block 1314.

At block 1314, the first and second tooling plates are positioned so that the flanges on the flanges on the conductive bodies are against the collars in the calibration tools. The first and second tooling plates are then pressed together, causing the array of guide tools to move down onto the conductive bodies and press the flanged surfaces against the collars of the guide tools. The pressing of the guide tools "flattens" the flanges and produces a planar flanged surface on each of the conductive bodies. The pressing action stops and the tooling plates are separated and the conductive bodies removed from the second tooling plate. If a calibration tool with a retractable annular disk is used, such as described in FIG. 14, the block 1314 would comprise pressing the second tooling plate with the guide tools over the conductive body and retracting or pushing the retractable annular disk out of the way so that the guide tool presses the flanged surface onto the top surface of the calibration tool. After the pressing is complete the flanged surface can be punched to a desired shape.

Flow ends in block 1316. As noted various types of conductive bodies can be make at the same time by using appropriate guide tools, calibration tools and expanding tools. For example, different types of extrusion can be used for the conductive bodies, different sized flanges can be made on different conductive bodies, and conductive bodies of various lengths can be made.

Figure 28:
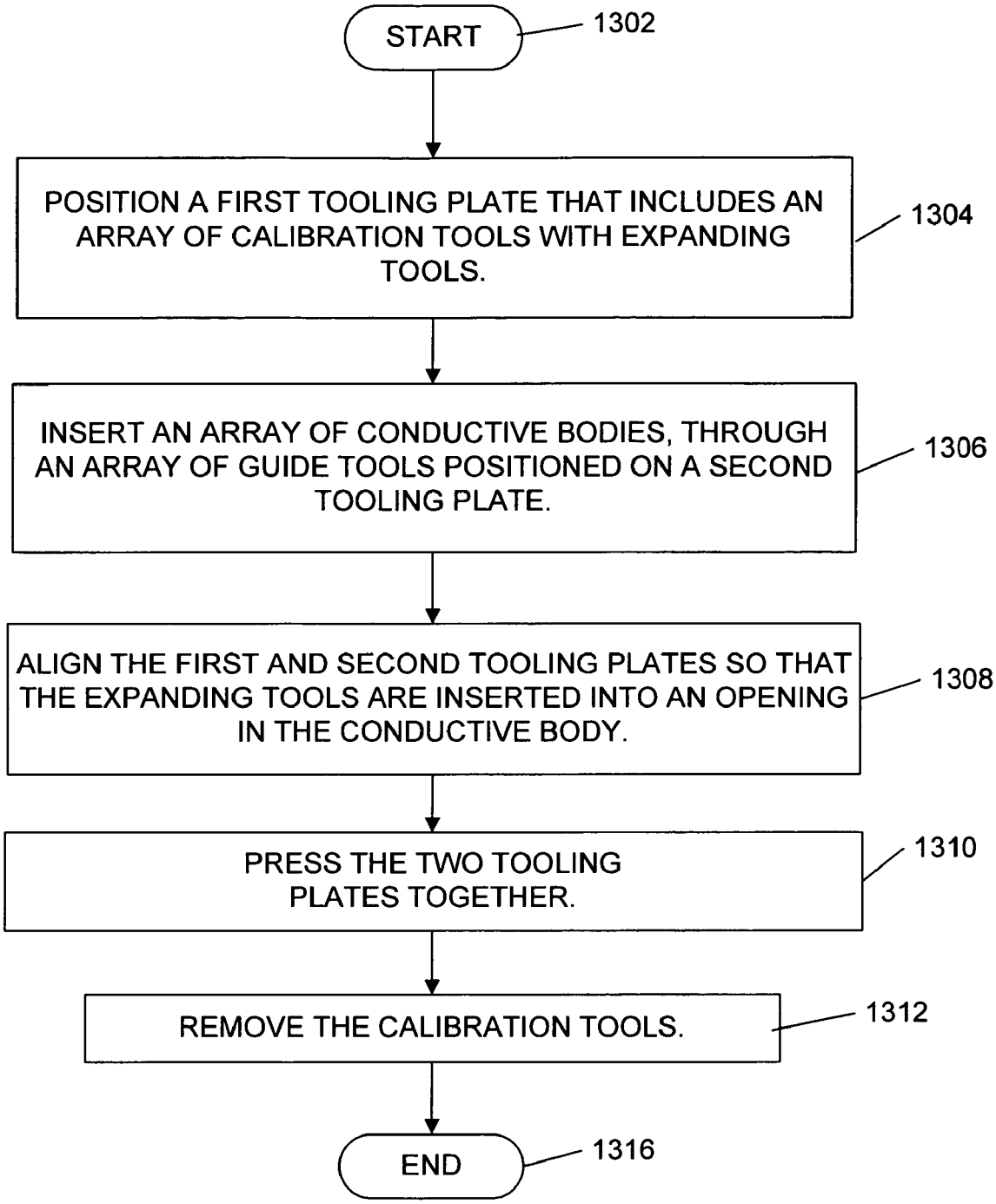

FIG. 28 is a flow diagram of another technique to simultaneously produce multiple flanged conductive bodies in the same procedure. Process flow in blocks 1302 through 1312 is the same as described for corresponding blocks in FIG. 22. In the technique of FIG. 23 it is desired to make conductive bodies with flanges having curved surfaces. In block 1310, pressing the conductive bodies over the expanding tool makes the desired flange. Process flow continues to block 1312 where the first and second tooling plates are separated and the conductive bodies removed from the calibration tools.

The process flow ends in block 1316.

Figure 29:
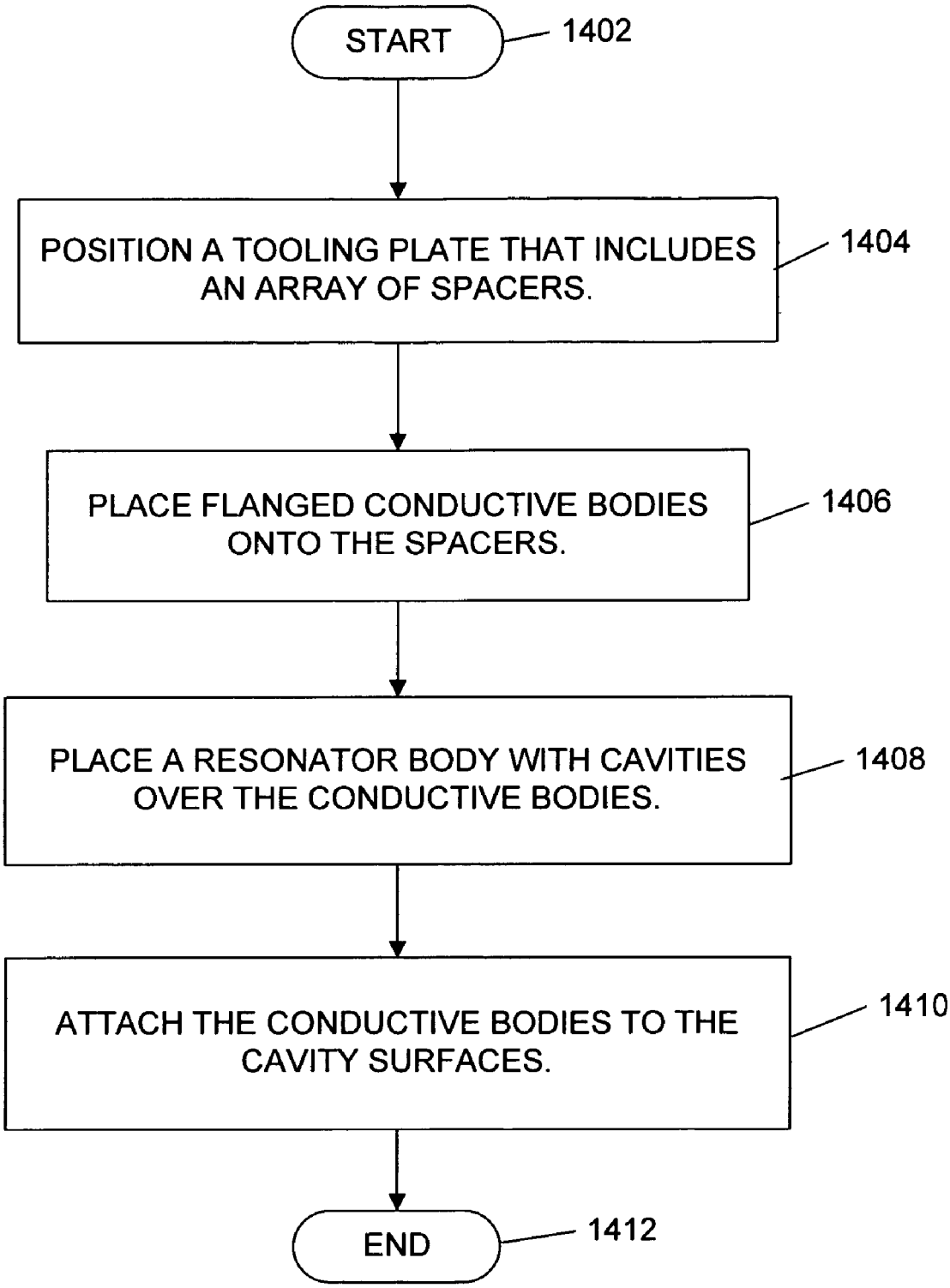
FIG. 29 is a flow diagram of a technique for installing a flanged conductive body as an inner conductor into a resonator cavity.

FIG. 29 is a flow diagram of a technique for installing a flanged conductive body as an inner conductor into a resonator cavity. The process flow begins at block 1402. At block 1404 a tooling plate that includes an array of spacers is positioned onto a press. Flow continues to block 1406, where flanged conductive bodies are placed onto the array of spacers. The flanged conductive bodies are placed on the spacers so that the flanged surfaces are in contact with the spacers. Flow continues to block 1408.

At block 1408, a resonator housing or body that includes at least one cavity is placed over the conductive bodies. The ends of the flanged conductive bodies opposite the flange contact an inner surface of the at least one cavity in the resonator body. Process flow continues to block 1410, where the conductive bodes are attached to the cavity surface. For example, there may be a hole a wall of the resonator body that corresponds to the location of the conductive body. A rivet can then be pressed into an opening in the conductive body, thereby securing the conductive body to the resonator housing.

Figure 30:
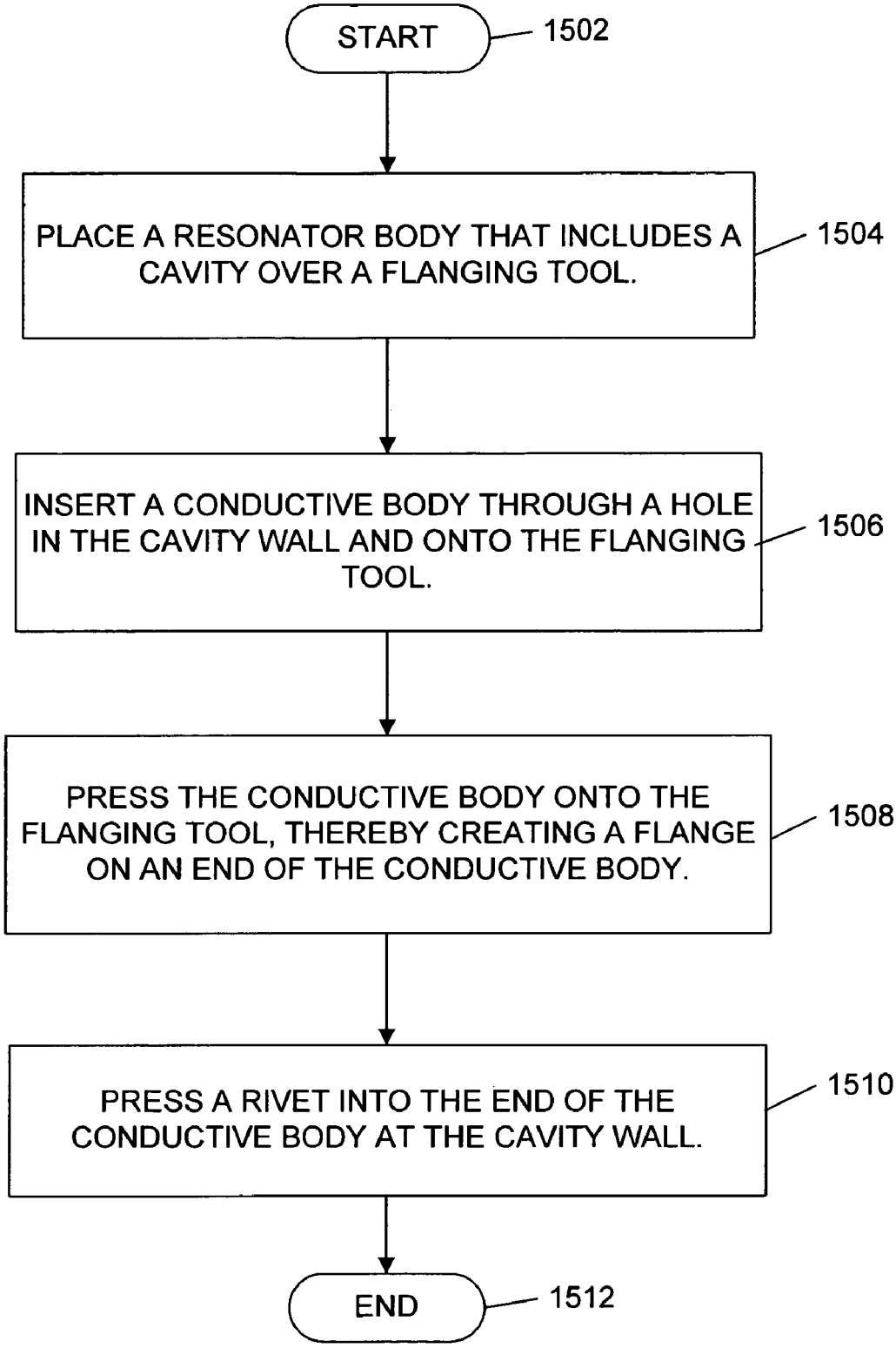
FIG. 30 is a flow diagram of a technique of flanging a conductive body and attaching the conductive body as an inner conductor of a cavity in a single procedure.

FIG. 30 is a flow diagram of a technique of simultaneously flanging a conductive body and attaching the conductive body as an inner conductor of a cavity in a single procedure. The process flow begins at block 1502. At block

1504 a resonator body that includes a cavity is placed over a flanging tool such that the flanging tool is inside the cavity. Flow continues to block 1506, where a first end of a conductive body is inserted through a hole in the resonator body cavity wall. The hole in the cavity wall corresponds to the location of the flanging tool so that the flanging tool enters an opening in the first end of the conductive body. Flow continues to block 1508.

At block 1508 a pressing tool presses a second end of the conductive body, pushing the conductive body through the hole of the cavity wall and onto the flanging tool, thereby creating a flange on the first end of the conductive body. The pressing action continues until the second end of the conductive body is located in a desired position for attachment to the cavity wall. The pressing tool is then removed and flow continues to block 1510. At block 1510 a riveting tool presses a rivet into an opening in the second end of the conductive body, thereby attaching the conductive body to the cavity wall such that the conductive body is configured as an inner conductor within the cavity.

Figure 31:
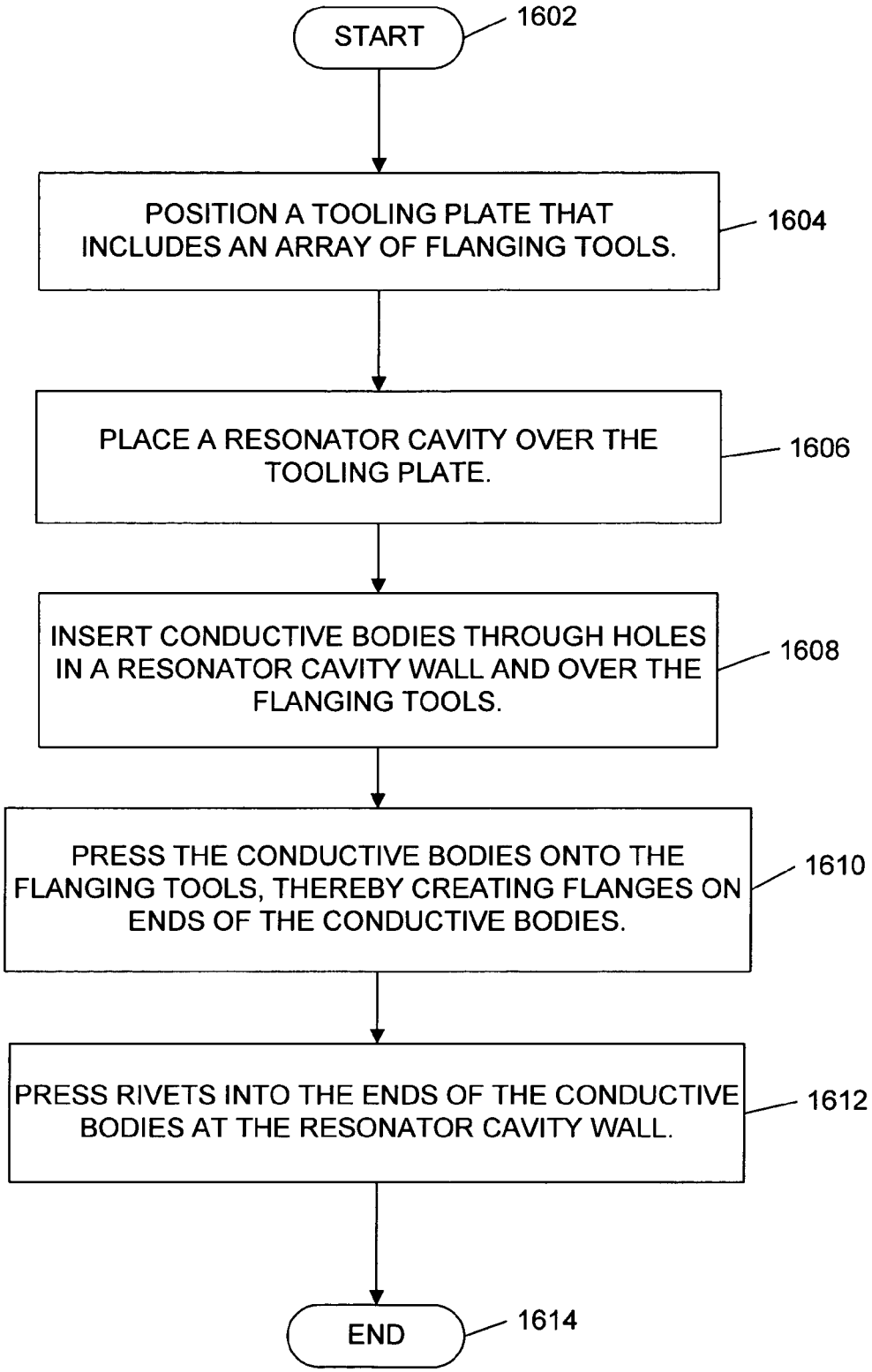
FIG. 31 is a flow diagram of a technique of flanging an array of conductive bodies and attaching the array conductive bodies as inner conductors in at least one cavity in a single procedure.

FIG. 31 is a flow diagram of a technique of flanging an array of conductive bodies and attaching the array conductive bodies as inner conductors in at least one cavity in a single procedure. Process flow begins in block 1602, and at block 1604 a tooling plate that includes an array of flanging tools is positioned in a press. At block 1606 a resonator housing or body that includes at least one cavity is placed over the array of flanging tools such that a flanging tool is inside one or more of the cavities. Process flow continues to block 1608, where a plurality of conductive bodies, each with a first and second end, are inserted through a plurality of holes in the corresponding resonator body cavity walls. The hole in each cavity wall corresponds to the location of the flanging tools so that each flanging tool enters an opening in the first end of an associated conductive body. Flow continues to block 1610.

At block 1610 a pressing tool associated with each conductive body presses the second end of each conductive body, pushing the respective conductive body through the hole of the cavity wall and onto the associated flanging tool, and thereby creating a flange on the first end of each conductive body. The pressing action continues until the second end of each conductive body is located in a desired position for attachment to the cavity wall. The pressing tool is then removed and flow continues to block 1612. At block 1612 a riveting tool presses a rivet into an opening in the second end of each conductive body, thereby attaching each of the conductive bodies to the cavity wall such that the conductive bodies are configured as inner conductors within the cavity.

The present invention has been described above in terms of presently preferred embodiments so that an understanding of the present invention can be conveyed. There are, however, many configurations for coaxial resonators not specifically described herein but with which the present invention is applicable. The present invention should therefore not be seen as limited to the particular embodiments described herein, but rather, it should be understood that the present invention has wide applicability with respect to coaxial resonators generally. All modifications, variations, or equivalent arrangements and implementations that are within the scope of the attached claims should therefore be considered within the scope of the invention.

We claim:

1. An inner conductor for use in a coaxial resonator, the inner conductor comprising an elongated conductive body having a first non-attached end with a flange formed on the non-attached end and a second end adapted to be attached to a surface of the resonator, wherein the flange is formed integrally with the conductive body in a process in which the non-attached end of the conductive body is pressed against a flanging tool such that the conductive body is sized and shaped so the flange provides a desired capacitance surface area.

2. An inner conductor as defined in claim 1, wherein the formed flange includes a planar transverse surface.

3. An inner conductor as defined in claim 1, wherein the formed flange comprises a curved surface.

4. An inner conductor as defined in claim 1, wherein the formed flange is curved backward on itself.

5. An inner conductor as defined in claim 1, wherein the flanging tool is inserted within an opening in the first end of the conductive body, wherein the conductive body is pressed over the flanging tool causing the first end of the conductive body to expand, thereby producing a curved flange of a desired size and shape to achieve the desired capacitance surface area for use in the resonator.

6. An inner conductor as defined in claim 5, wherein the flanging tool comprises: a guiding tool having a hollow center in which the conductive body can be received; an expanding tool that is configured to be inserted within the open first end of the conductive body; and a calibration tool that cooperates with the expanding tool such that pressing the conductive body over the expanding tool causes the first end of the conductive body to expand into the calibration tool, thereby producing the flange having the desired size defined by a collar of the calibration tool such that the flange achieves the desired capacitance surface area when used in the coaxial resonator, wherein pressing the guiding tool on the flange produces the flange surface having the desired shape for the resonator.

7. An inner conductor as defined in claim 6, wherein the calibration tool further includes a support that holds the expanding tool in position such that pressing the guiding tool onto the flange retracts the expanding tool into the calibration tool so that the desired shape of the flanged surface is achieved.

8. An inner conductor as defined in claim 7, wherein the calibration tool further includes an annular disk, supported by a retractable support, wherein the annular disk extends around the outer surface of the calibration tool and extends above an upper surface of the calibration tool so as to form the collar, and the annular disk retracts so that pressing the guiding tool onto the flange flattens the flange.

9. An inner conductor as defined in claim 6, wherein attaching the second end of the conductive body to an inner surface of cavity wall comprises riveting.

10. An inner conductor as defined in claim 6, wherein the conductive body has a generally cylindrical shape.

11. An inner conductor as defined in claim 5, wherein the flanging tool comprises: a guiding tool with a hollow center into which the conductive body can be placed; an expanding tool that is configured to be inserted within the open first end of the conductive body; and a calibration tool that cooperates with the expanding tool such that pressing the conductive body over the expanding tool causes the first end of the conductive body to expand into the calibration tool, thereby producing the flange of the desired size, and pressing the guiding tool onto the flange flattens the flange so that it achieves a desired flatness suitable for the resonator.

12. An inner conductor for use in a coaxial resonator, the inner conductor comprising an elongated conductive body having a first non attached end with a flange formed on the non-attached end, and a second end adapted to be attached to a surface of the resonator, wherein the flange is formed integrally with the conductive body in a process in which the non-attached end of the conductive body is pressed against a flanging tool and the flange is trimmed to be sized and shaped so the flange provides a desired capacitance surface area when used in the resonator.

13. An inner conductor as defined in claim 12, wherein the formed flange includes a transverse planar surface.

14. An inner conductor as defined in claim 12, wherein the formed flange comprises a curved surface.

15. An inner conductor as defined in claim 12, wherein the formed flange is curved backward on itself.

16. An inner conductor as defined in claim 12, wherein the flange forming process further includes inserting the flanging tool within an opening in the first end of the conductive body, wherein pressing the conductive body over the flanging tool causes the first end of the conductive body to expand, thereby producing a curved flange of a desired size and shape to achieve the desired capacitance surface area for use in the resonator.

* * * * *